US006208499B1

(12) United States Patent
Yonekawa et al.

(10) Patent No.: US 6,208,499 B1
(45) Date of Patent: Mar. 27, 2001

(54) CORONA DISCHARGE DEVICE

(75) Inventors: Noboru Yonekawa; Yasuhiro Nakagami; Kouji Matsushita, all of Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 08/272,700

(22) Filed: Jul. 8, 1994

(30) Foreign Application Priority Data

Jul. 12, 1993 (JP) ..... 5-171864
Jul. 12, 1993 (JP) ..... 5-171882
Jul. 12, 1993 (JP) ..... 5-171896

(51) Int. Cl.[7] ..... G03G 15/00
(52) U.S. Cl. ..... 361/220; 361/213; 361/214
(58) Field of Search ..... 361/212, 213, 361/214, 220, 221, 222, 225, 229, 230; 250/324–326; 355/221, 222, 224

(56) References Cited

U.S. PATENT DOCUMENTS 3,691,373 9/1972 Compton et al. ..... 250/49.5 ZC
4,574,326 3/1986 Myochin et al. ..... 361/229
4,591,713 5/1986 Gundlach et al. ..... 250/326
4,725,731 2/1988 Lang ..... 250/326
4,792,680 12/1988 Lang et al. ..... 250/325
5,241,122 * 8/1993 Woell et al. ..... 568/485

* cited by examiner

*Primary Examiner*—Fritz Fleming
(74) *Attorney, Agent, or Firm*—Sidley & Austin

(57) ABSTRACT

A corona discharge device used in an electrophotographic image forming apparatus includes a discharge member such as a saw-toothed discharge member having sharp discharge ends, and a power supply which applies to the discharge member a discharge voltage containing at least an AC voltage component, wherein at least each discharge end portion of the discharge member is made of an electrically conductive material, which contains nickel and chromium, and/or is coated with a material having a high electric resistance. In the case where the saw-toothed discharge member is employed, a distance D between the discharge end and a member to be charged, and a discharge end pitch P are determined to satisfy a relationship of $2 \leqq D/P \leqq 8$.

20 Claims, 26 Drawing Sheets ta tb tc

CORONA DISCHARGE DEVICE

BACKGROUND OF THE INVENTION

1. Field of the Invention

The present invention relates to a corona discharge device used in an electrophotographic image forming apparatus such as a copying machine and a printer.

2. Description of the Related Art

In many electrophotographic image forming apparatuses, corona discharge devices have been used, for example, as a charger for uniformly charging a surface of an electrostatic latent image carrier such as a photosensitive drum prior to formation of an electrostatic latent image corresponding to an original image, a transfer charger for transferring a toner image formed by development of the electrostatic latent image onto a transfer sheet of paper, and a separation charger for separating the transfer sheet from the electrostatic latent image carrier after the transfer of the toner image.

The corona discharge device generally employs a discharge electrode formed of a wire electrode which extends continuously along a charge receiving member, i.e., a member to be charged.

Recently, it has been proposed to use a DC (direct current) charge device as a discharge device employing a saw-toothed electrode instead of the wire electrode, for example, in Japanese Laid-Open Patent Publication No. 5-19591 (1993). Further, a discharge device provided with a charging roller has also been proposed.

If an organic photosensitive member is used as the electrostatic latent image carrier, the surface of the photosensitive member is negatively charged. If a well-known selenium photosensitive member is used, the surface is positively charged. In this manner, the member to be charged such as the photosensitive member is charged to attain an intended polarity. For this purpose, the DC corona discharge has generally been used.

According to the corona discharge device employing the wire electrode, however, a majority of a high voltage energy, which is applied to the wire for the discharging operation, is consumed to generate ozone, so that a large amount of ozone disadvantageously generates during the discharging operation.

If the ozone concentration is high, product such as $NO_X$ which is formed by oxidation with ozone adheres onto the surface of the electrostatic latent image carrier such as a photosensitive drum, so that the electric resistance at the surface of the electrostatic latent image carrier decreases, resulting in movement of the electric charges (electrostatic latent image), i.e., a so-called a "dislocation of the image".

In the prior art, it has been attempted to exclude the discharge product such as the aforementioned product and ozone, from the image forming apparatus, by providing a ventilation fan and/or an ozone filter. Such discharge product adversely affects the human body, so that the discharge product which is released from the apparatus has been regarded as a serious issue in accordance with a movement for the protection of the environment. In particular, the amount of generated ozone released from the copying machines and others has been restricted in accordance with the approval standards relating to a blue angle mark for indication of safety in Japan and European countries as well as the UL standards which are the safety standards in U.S.A.

The DC corona discharge device having the saw-toothed electrode described above can reduce the amount of generated ozone to a value from about ⅓ to about ¼ of that by the device having the wire electrode. Even if the discharge device including the saw-toothed electrode is employed, a relatively large amount of ozone is released from the image forming apparatus as a whole, because the image forming apparatus includes, in addition to the discharge device for charging the electrostatic latent image carrier, the transfer device and others which perform the discharge operation.

Further, the discharge device employing an electrode having needle-like tip ends such as the saw-toothed electrode does not have sufficient reliability. If the discharge operation is performed for a long time, tip ends of the electrode are oxidized, and dust or the like is deposited the tip ends, resulting in irregular discharge.

Further, the electrode having needle-like tip ends such as a saw-toothed electrode applies the electric charges through a plurality of discharge points to the charge receiving member. It is therefore necessary to set an appropriate pitch between the discharge points as well as a distance between the discharge point and the charge receiving member in order to apply the electric charges uniformly to the charge receiving member.

If the pitch between the discharge points is excessively small, interference between electric fields by adjacent discharge points occurs, resulting in the irregular discharge. If the pitch is excessively large, a large difference occurs in the discharge voltage between a position near the discharge point and a position remote therefrom, resulting in the irregular discharge. If the space or gap between the discharge point and the charge receiving member is excessively small, the electric charges are applied to local portions of the charge receiving member, resulting in the irregular discharge. If the gap is excessively large, the supply voltage for the discharge must be large, resulting in increase of the sizes of the apparatus.

Although the discharge device employing the charging roller described above generates a smaller amount of ozone than the discharge device employing the wire electrode, it cannot comply with the high-speed image formation which has been required in recent years.

SUMMARY OF THE INVENTION

Accordingly, it is an object of the invention to provide a corona discharge device used in an electrophotographic image forming apparatus, which generates a smaller amount of ozone than the conventional DC corona discharge device using the saw-toothed electrode, and can comply with the high-speed image formation.

Another object of the invention is to provide a corona discharge device used in an electrophotographic image forming apparatus, which can reduce an amount of generated ozone, includes a discharge member having high durability, and can perform a stable discharge operation.

Still another object of the invention is to provide a corona discharge device used in an electrophotographic image forming apparatus, which can reduce an amount of generated ozone, and can apply electric charges uniformly to a charge receiving member to be charged.

The inventors of the present invention have eagerly made a study for achieving the above first object, and found that if a discharge member having sharp discharge ends is employed and a discharge voltage containing an AC voltage component is applied thereto for corona discharge, the amount of generated ozone is further reduced as compared with the DC corona discharge device using the saw-toothed electrode in the prior art.

Based on the above finding, the present invention provides a corona discharge device used in an electrophotographic image forming apparatus, which includes a discharge member provided with sharp discharge ends, and means for applying a discharge voltage containing at least an AC voltage component to the discharge member.

In this discharge device, the discharge member provided with the sharp discharge ends may be a saw-toothed discharge member as employed in an embodiment shown in FIG. 1(A), which will be described later, and also may be any one of members shown in FIGS. 2(A), 2(B) and 2(C), which are provided with razor-like discharge ends ta, wire discharge ends tb and needle-like discharge ends tc, respectively.

It is desired that the AC voltage component applied to the discharge member has an AC frequency not lower than 400 Hz in view of reduction of generated ozone. However, if the frequency is excessively high, a leak current increases. Therefore, the frequency not higher than 1.5 kHz is desirable. In view of reduction of generated ozone, it is desired that a sum of positive and negative current components of a discharge current is equal or close to 0, and a practical range of the sum is, for example, from −200 $\mu$A to +100 $\mu$A.

According to this corona discharge device, the sharp discharge ends of the discharge member are directed toward the charge receiving member, i.e., the member to be charged, and the means for applying the discharge voltage applies to the discharge member the discharge voltage containing at least the AC voltage component to perform the corona discharge, so that electric charges are applied to the charge receiving member. Since the discharge voltage contains the AC voltage component, generation of ozone is suppressed during the discharge. The device can comply with the high-speed image formation.

The inventors of the present invention have also made a study for achieving the second object described above, and found that, in the case where the discharge member having the sharp discharge ends such as the saw-toothed electrode is employed for suppressing the generation of ozone, if each discharge end portion is made of electrically conductive material containing an appropriate amount of nickel and chromium, resistances against heat and corrosion are improved and oxidation of the discharge end is suppressed, so that the durability is improved and the stable discharge can be performed. The inventors also have found that, in the aforementioned case, if an appropriate amount of molybdenum is additionally contained in the conductive material, the resistance against the corrosion is further improved, and thus the durability is further improved. It is further found that, if each discharge end portion of the discharge member is coated with electrically insulating material, oxidation can be suppressed, which results in improvement of the durability and the discharge stability, and the amount of generated ozone can be reduced.

In view of the above findings, the present invention provides a corona discharge device used in an electrophotographic image forming apparatus, in which a discharge member has sharp discharge ends, and at least each discharge end portion including the sharp discharge end is made of electrically conductive material containing nickel in a range from 8% to 15% and chromium in a range from 16% to 20%, and also provides a corona discharge device used in an electrophotographic image forming apparatus, in which a discharge member has sharp discharge ends, and at least each discharge end portion including the sharp discharge end is covered with material having a high electric resistance.

Also in the discharge devices of the above two types, the discharge member provided with the sharp discharge ends may be a saw-toothed discharge member as employed in an embodiment shown in FIG. 1(A), which will be described later, and also may be members shown in FIGS. 2(A), 2(B) and 2(C), which are provided with razor-like discharge ends ta, wire discharge ends tb and needle-like discharge ends tc, respectively.

The discharge end portion made of the material containing nickel and chromium may additionally contain a small amount of molybdenum for further improvement of the resistance against corrosion. The content of molybdenum is preferably from 2% to 3%, because an excessively small content cannot achieve the intended effect and an excessively large content increases the electric resistance, resulting in an excessive load on a power supply.

The device may include the feature that the discharge end portion is made of the material containing nickel and chromium, and optionally molybdenum in combination with the feature that the discharge end portion is covered with the high resistance material.

In any case, the conductive material containing nickel and chromium, and optionally molybdenum may be alloy containing iron as a major substance.

The content of nickel is preferably from 8% to 15%. If the content is lower than 8%, the intended effect by the nickel cannot be obtained. If it is larger than 15%, a tensile strength and a hardness are impaired. More preferably, the content of nickel is from 10% to 14%. The content of chromium is preferably from 16% to 20%. If it is smaller than 16%, the intended effect by the chromium cannot be obtained. If it is larger than 20%, a tensile strength and a hardness are impaired. More preferably, the content of chromium is from 16% to 18%.

The high resistance material coating the discharge end portion of the discharge member may be dielectric material such as ceramics, and more specifically, such as glass, silicon oxide ($SiO_2$), silica, silica-alumina or alumina. The coating is performed, for example, by vapor deposition, application of material or fitting of a tube member. The thickness of the coating is preferably not larger than 0.1 mm, and more preferably is not larger than 0.01 mm. If the thickness is larger than 0.1 mm, the dielectric voltage becomes excessively large, in which case a spark is liable to generate.

According to the corona discharge devices described above, the sharp discharge ends of the discharge member are directed toward the charge receiving member, i.e., the member to be charged, and the discharge voltage is applied from the discharge power supply to the discharge member, so that the corona discharge occurs and electric charges are applied to the charge receiving member.

In the case where the discharge end of the discharge member is made of the conductive material containing nickel and chromium, and optionally molybdenum, these contained materials such as nickel suppresses oxidation of the discharge ends. If the discharge end is coated with the material having a high electric resistance, this also suppresses oxidation of the discharge end. Accordingly, the stable discharge operation can be performed for a long time. If each discharge end portion is coated with the material having a high electric resistance, this structure suppresses generation of ozone during the discharge operation by itself.

The inventors of the present invention have further made a study for achieving the third object described above, and found that, in the case where the discharge member such as a saw-toothed electrode having a plurality of sharp discharge ends is used for suppressing generation of ozone, there is a specific relationship between, on the one hand, a pitch between the discharge ends and, on the other hand, a gap between the discharge end and the charge receiving member, i.e., the member to be charged, according to which irregular discharge can be suppressed without increasing the sizes of the apparatus. Based on this finding, the invention provides the following corona discharge device.

The corona discharge device used in an electrophotographic image forming apparatus includes a discharge member having a plurality of sharp discharge ends arranged in one row, wherein a distance D (mm) of a space between the discharge end and a charge receiving member to be charged or a path of the charge receiving member, and a pitch P (mm) between the discharge ends are determined to establish a relationship of $2 \leqq D/P \leqq 8$.

If the charge receiving member is located at a fixed position, as in the case where the charge receiving member is an electrostatic latent image carrier, the distance D is the distance between the charge receiving member and the discharge end. If the charge receiving member is fed and moved only when required, as in the case where the charge receiving member is a transfer sheet, the distance D is the distance between the discharge end and the path through which the charge receiving member moves.

A value of D/P smaller than 2 or larger than 8 causes irregular discharge which is not practically neglectable.

The discharge member provided with the sharp discharge ends may be a saw-toothed discharge member as employed in an embodiment shown in FIG. 1(A), and also may be any one of members shown in FIGS. 2(A), 2(B) and 2(C), which are provided with razor-like discharge ends ta, wire discharge ends tb and needle-like discharge ends tc, respectively.

According to this corona discharge device, the sharp discharge ends of the discharge member are directed toward the charge receiving member and are spaced therefrom by the distance D (mm) which satisfies together with the discharge end pitch P the relationship of $2 \leqq D/P \leqq 8$, and the discharge voltage is applied to the discharge member, whereby corona discharge occurs and electric charges are uniformly applied to the charge receiving member.

The various features of the corona discharge devices according to the invention described above may be arbitrarily combined with each other for further enhancing the effects of the invention, i.e., suppression of generation of ozone, improvement of durability of the discharge device, stabilization of the discharge operation and uniform charging of the charge receiving member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the invention will be described below with reference to the drawings.

Figure 1A:
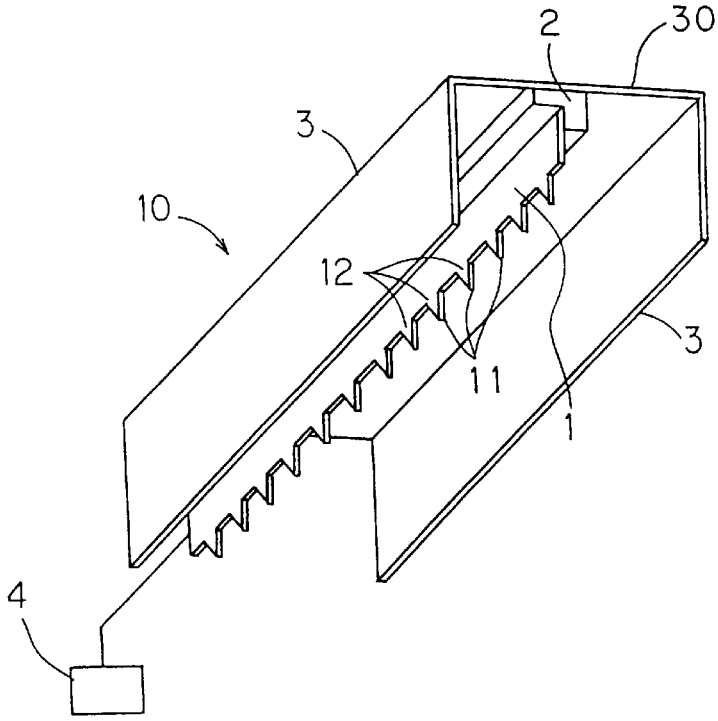
FIG. 1(A) is a perspective view showing an embodiment of the invention.
Figure 1B:
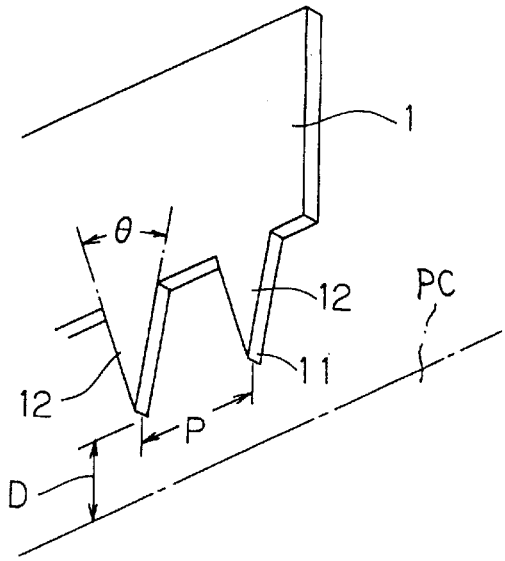
FIG. 1(B) is a fragmentary enlarged perspective view showing a discharge member shown in FIG. 1(A)

FIG. 1(A) is a perspective view of a corona discharge device 10 of an embodiment, and FIG. 1(B) is fragmentary enlarged perspective view of a discharge member 1 provided at the device 10.

The discharge device 10 includes a discharge member 1 and a discharge power supply 4 connected thereto. The discharge device is assembled in an electrophotographic image forming apparatus, and is used, for example, for charging a surface of a photosensitive drum PC prior to formation of an electrostatic latent image.

Figure 2A:
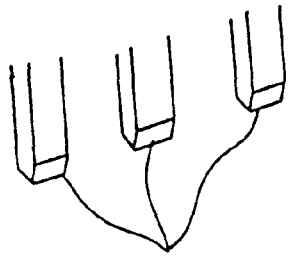
FIGS. 2(A), 2(B) and 2(C) show various examples of a shape of a discharge end portion of the discharge member.
Figure 2B:
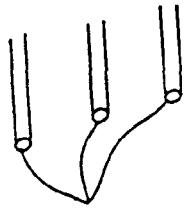
Figure 2C:
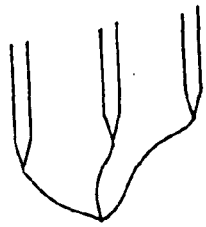

The discharge member 1 includes a plurality of sharp discharge ends 11 which are spaced with a constant pitch P from each other and are arranged in a direction along a surface of a charge receiving member to be charged, i.e., the photosensitive drum PC in the illustrated embodiment. Thus, the discharge member 1 has a saw-toothed form as a whole. Each discharge end 11 is formed at a tip end of a triangular saw-toothed portion 12, and corona discharge is performed therefrom. The saw-toothed discharge member can be formed by effecting etching, or rolling and pressing on a plate made of an electrically conductive material without difficulty. As shown in FIGS. 2(A), 2(B) and 2(C), the member may be provided with razor-like discharge ends ta, wire discharge ends tb or needle-like discharge ends tc.

The pitch P between the discharge ends 11 should be neither excessively small nor excessively large in view of suppression of irregular discharge and stabilization of discharge. The distance D between the charge receiving member, i.e., the member to be charged and the discharge end 11 should not be excessively small, otherwise the charge receiving member is locally supplied with the electric charges and thus cannot be charged uniformly and/or other problem such as abnormal discharge may occur. The distance D also should not be excessively large, otherwise such problems occur that the power supply voltage must be high and the sizes of the discharge device increase.

Accordingly, in order to apply the electric charges uniformly to the charge receiving member, the pitch P (mm) and the distance D between the charge receiving member and the discharge end are determined to satisfy the relationship of $2 \leqq D/P \leqq 8$.

A tooth angle θ of each saw-toothed portion 12 shown in FIG. 1(B) is set a value not larger than 30° because a larger value increases the amount of generated ozone, and specifically is set in a range from 5° to 15° because an excessively small value causes problems relating to the workability and strength.

A thickness t of the saw-toothed portion 12 is set to a value not larger than 0.1 mm and is preferably set to about 0.05 mm, because an excessively small value causes insufficient strength, although the amount of generated ozone decreases in accordance with the reduction of the thickness t.

If the corona discharge caused oxidation of the discharge member 1, and in particular, portions including the discharge ends 11 as well as adhesion of minute dust thereto, irregular discharge would be caused. Therefore, it is desired to suppress the oxidation and adhesion of the dust, and thereby to improve the durability and stabilize the discharge. The improvement of the durability can be achieved by improving the resistance against corrosion and heat, so that the conductive material forming the discharge member 1 may preferably be alloy containing chromium(Cr) and nickel (Ni), and additionally may contain molybdenum(Mo) in view of further improvement of the resistance against heat and corrosion. More specifically, it may contain chromium from 16% to 20% (more preferably, from 16% to 18%), and nickel from 8% to 15% (more preferably, from 10% to 14%). If contents of these materials were excessively large, the tensile strength and hardness would be impaired, and also the manufacturing cost would increase. If molybdenum (Mo) is added thereto, the content is set in a range from about 2% to about 3%. An excessively large content thereof would increase the electric resistance and would cause a large load on the power supply. The discharge member may alternatively be made of an electrically conductive plate such as a copper plate on which anti-corrosion treatment such as nickel plating is effected.

Figure 1C:
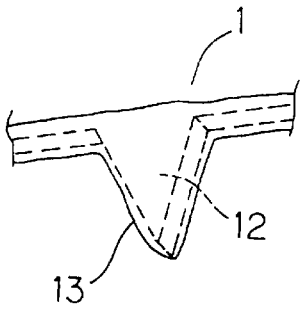
FIG. 1(C) is a perspective view showing a structure in which a discharge end of the discharge member shown in FIG. 1(A) is coated with a material having a high electric resistance.

The discharge member 1, and in particular, the discharge end portions including the discharge ends 11 may be coated with material (e.g., dielectric material such as ceramics) having a high electric resistance, as shown in FIG. 1(C), for the purpose of reducing the amount of generated ozone, improvement of durability and improvement of stability of the discharge. Such dielectric material may be preferably ceramics, and more particularly, glass, silicon oxide ($SiO_2$), silica, silica alumina, or alumina. The film thickness of the coating is not larger than 0.1 mm and preferably not larger than 0.01 mm, because an excessively large thickness would increase the dielectric voltage, and thus might cause a spark.

The coating film may be formed by an appropriate method such as vapor deposition, application of material or fitting of a tube member.

Figure 3A:
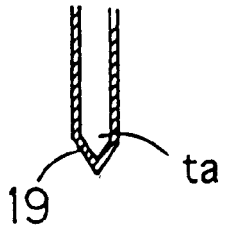
FIGS. 3(A), 3(B) and 3(C) show various example of coating of the discharge end portions shown in FIGS. 2(A), 2(B) and 2(C) with a material having a high electric resistance, respectively.
Figure 3B:
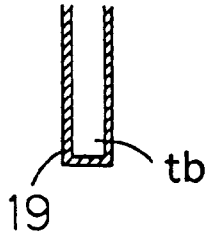
Figure 3C:
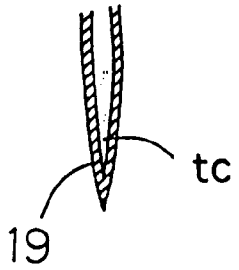

In the case where the discharge end has the shape shown in FIG. 2(A), 2(B) or 2(C), the similar effect can be obtained by coating the discharge end portions with material 19 having a high electric resistance as shown in FIG. 3(A), 3(B) or 3(C).

The power supply 4 connected to the discharge member 1 can apply the discharge voltage which contains at least an AC voltage component for the purpose of reduction of the generated ozone and stabilization of the charge. As the frequency of the applied AC voltage increases, the amount of generated ozone decreases. However, the higher frequency would increase the leak current. Therefore, the frequency is set to a value from 400 Hz to 1.5 kHz. As the sum of positive and negative components of the discharge current approaches 0, the amount of generated ozone decreases, so that the sum of the current components is set to a value from −200 $\mu$A to +100 $\mu$A.

The discharge member 1 described above is supported by a holder member 2, and is disposed between a pair of stabilizers or stabilizing plates 3 which extend parallel to the discharge member 1. The holder member 2 and the stabilizers 3 are supported by the top stabilizer 30. Opposite ends of the holder member 1 may be held in a manner similar to a conventional wire electrode, in which case the holder member 2 can be eliminated. The stabilizers 3 are not essential. The stabilizers, if employed, may be or may not be electrically conductive, but is preferably made of electrically conductive material for stabilizing the discharge. A grid may be located near an open end of the stabilizers 3 and between a charge receiving member (i.e., member to be charged) and the discharge member 1 for further stabilization of the discharge.

According to the corona discharge device 10 described above, the discharge ends 11 of the discharge member 1 arranged in a row are directed toward the charge receiving member, i.e., a surface of the photosensitive drum PC in the illustrated embodiment. In this case, the distance D (mm) between the discharge ends and the surface of the drum PC is determined to satisfy the relationship of $2 \leqq D/P \leqq 8$, where P is the pitch between the discharge ends 11.

The discharge power supply 4 supplies to the discharge member 1 the discharge voltage containing at least the AC voltage component, whereby the corona discharge is performed so that the surface of the photosensitive drum PC is charged.

In the discharging operation for charging the drum described above, generation of ozone is suppressed as compared with the case where a DC voltage is merely applied by the conventional saw-toothed electrode, because the discharge voltage of the embodiment contains the AC voltage component. Since the device is set to satisfy the relationship of $2 \leqq D/P \leqq 8$, the surface of the photosensitive drum is uniformly charged.

If the discharge end portions including discharge ends 11 of the discharge member 1 are made of the conductive material containing nickel and chromium, and optionally molybdenum, the contained material such as nickel suppresses oxidation of the discharge ends. If the discharge end portions are coated with the material having a high electric resistance, this also suppresses oxidation of the discharge ends, so that adhesion of dust will be suppressed for a long time, which enables the stable discharge. If the discharge end portions are coated with the material 13 (FIG. 1(C)) having a high electric resistance, this also suppresses generation of ozone during discharge.

Experiments and others, which support the effect of the embodiment of the invention already described, will be described hereinafter.

With Respect to Materials

Discharge was performed for 100 hours with each of discharge members 1(1), 1(2) and 1(3) made of different materials, and adhesion of dust onto the discharge end was determined with an electron microscope for evaluating durability.

Discharge member 1(1): major material=iron (95% or more)

Discharge member 1(2): material=iron(major material)+chromium (18%)+nickel (10%)

Discharge member 1(3): material=iron(major material)+chromium (18%)+nickel (10%)+molybdenum (2%)

Figure 4:
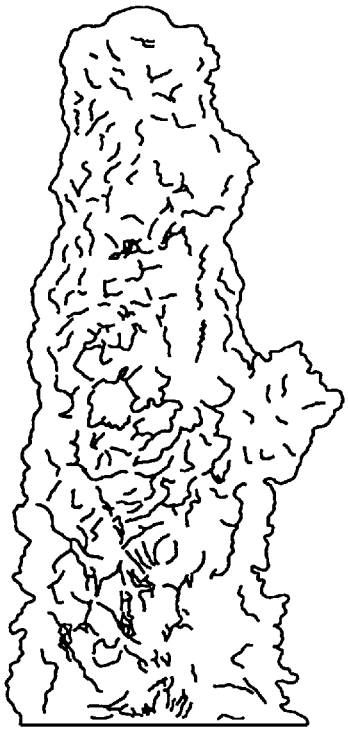
FIG. 4 is an enlarged view showing a state of an iron discharge end portion after discharge for 100 hours.
Figure 5:
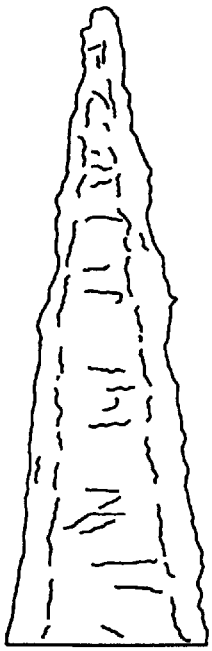
FIG. 5 is an enlarged view showing a state of a discharge end portion made of iron and additionally containing nickel and chromium before use.
Figure 6:
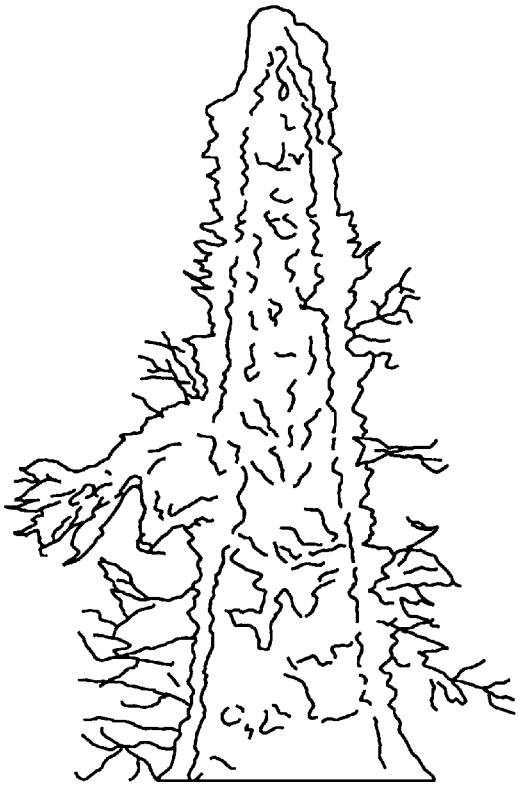
FIG. 6 is an enlarged view showing a state of the discharge end portion shown in FIG. 5 after discharge for 100 hours.
Figure 7:
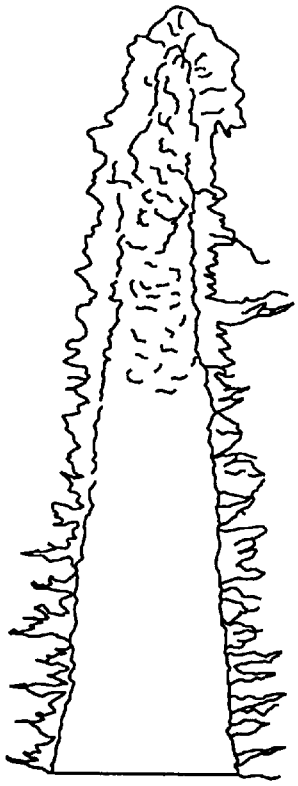
FIG. 7 is an enlarged view showing a state of a discharge end portion made of iron and additionally containing nickel, chromium and molybdenum after discharge for 100 hours.

FIG. 4 is a diagram prepared from an electron microscope photograph and showing the discharge end portion of the discharge member 1(1) after the discharge for 100 hours. In FIG. 4, a large amount of dust has adhered to the surface of the electrode. FIG. 5 is a diagram prepared from an electron microscope photograph and showing the initial state of the discharge end portion of the discharge member 1(2) before the discharge. There is almost no adhesion on the electrode in FIG. 5. FIG. 6 is a diagram prepared from an electron microscope photograph and showing the state of the same of the member 1(2) after discharge for 100 hours. In FIG. 6, although dust has adhered to the surface of the electrode, the amount thereof is smaller than that in the case of the discharge member 1(1). FIG. 7 is a diagram prepared from an electron microscope photograph and showing the state of the discharge end portion of the discharge member 1(3) after discharge for 100 hours. In FIG. 7, although dust has adhered to the surface of the electrode, the amount thereof is smaller than that in the case of the discharge member 1(2).

From the above result, it can be understood that the amount of dust adhering to the discharge end can be reduced by using the discharge member, and particularly the discharge end portion made of conductive material containing chromium and nickel. Thus, the durability is improved. The durability is further improved by adding molybdenum thereinto.

Figure 8:
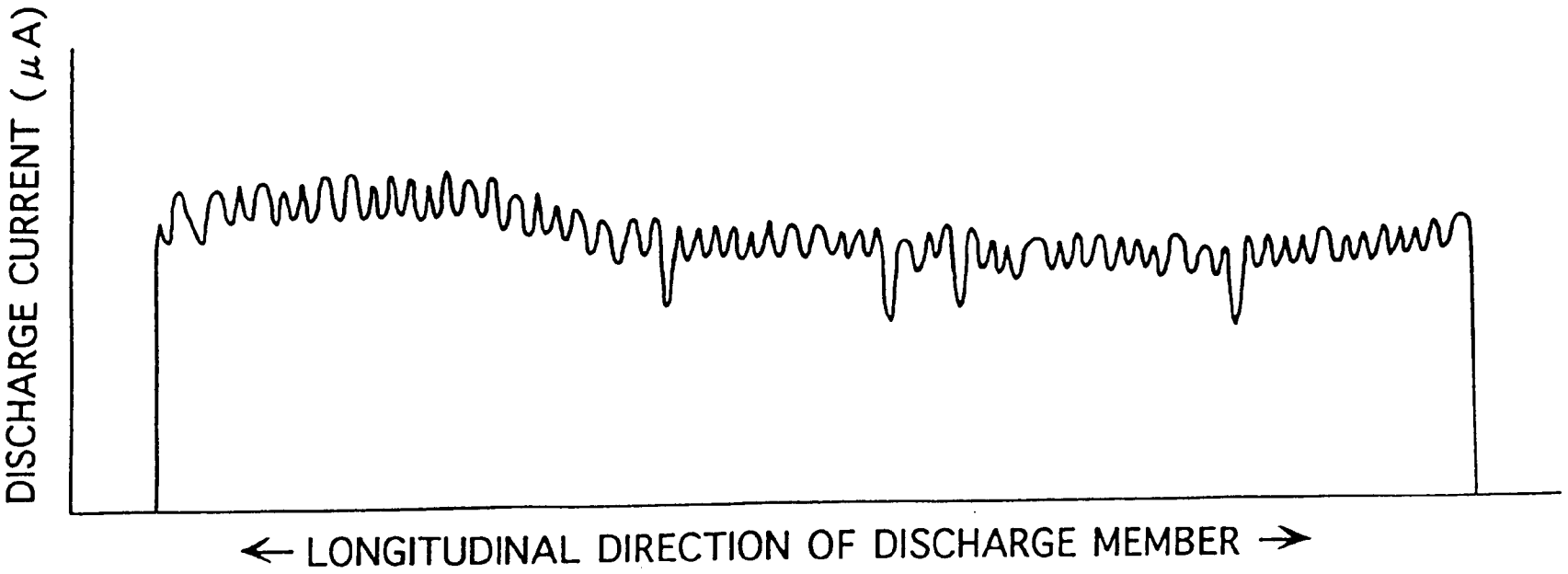
FIG. 8 is a graph showing a result of measurement of discharge currents flowing from longitudinally various portions of a discharge member made of iron toward a charge receiving member.
Figure 9:
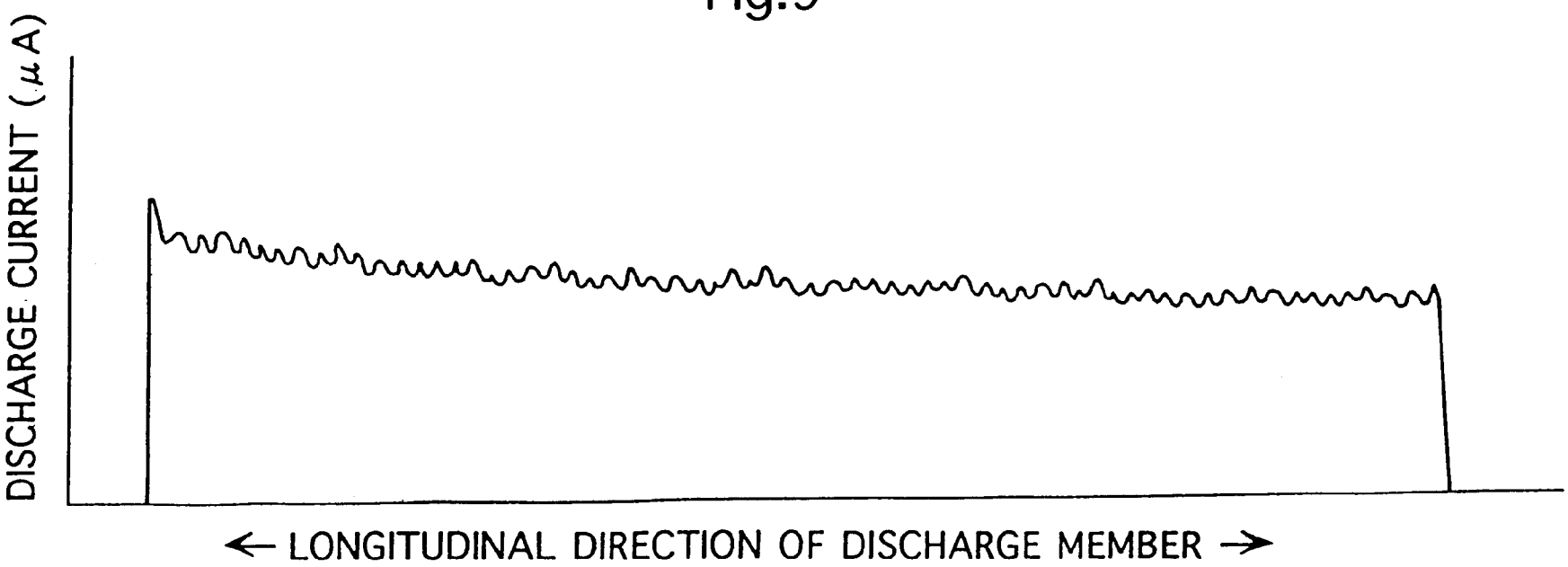
FIG. 9 is a graph showing a result of measurement of discharge currents flowing from longitudinally various portions of a discharge member made of iron and additionally containing nickel, chromium and molybdenum toward a charge receiving member.

FIG. 8 is a graph showing a result of measurement of the discharge currents flowing from longitudinally various portions of the discharge member 1(1) made of iron toward the charge receiving member. FIG. 9 is a graph showing a result of measurement of the discharge currents flowing from longitudinally various portions of the discharge member 1(3), which is made of iron and also contains nickel, chromium and molybdenum, toward the charge receiving member.

It can be understood from FIG. 8 that considerable "irregularities" generate with respect to the discharge currents at longitudinally various portions of the discharge member 1(1). It can be understood from FIG. 9 that the discharge currents are uniformly distributed over longitudinally various portions of the discharge member 1(3).

With respect to tooth angle θ and discharge end pitch P of saw-toothed portion 12, and distance D between charge receiving member and discharge end According to the corona discharge device employing a discharge member having sharp discharge ends, the configurations of the discharge end, stabilizer and others greatly affect the stability of discharge (in other words, irregularities of discharge) and the amount of generated ozone. The following description will be given on the relationship between, on the one hand, the tooth angle θ of the saw-toothed portion 12 of the discharge member 1, the pitch P between the discharge ends 11, the distance D between the discharge end 11 and the charge receiving member and others, and, on the other hand, the stability of the discharge operation and the amount of generated ozone.

With respect to the "irregularities of the discharge", it was determined that the irregularities occurred when there was a difference between the detected values of currents flowing from the electrodes at longitudinally various positions toward the charge receiving member during the corona discharge. The irregularities of the discharge correspond to an image noise at the time of sampling of the image.

Figure 10:
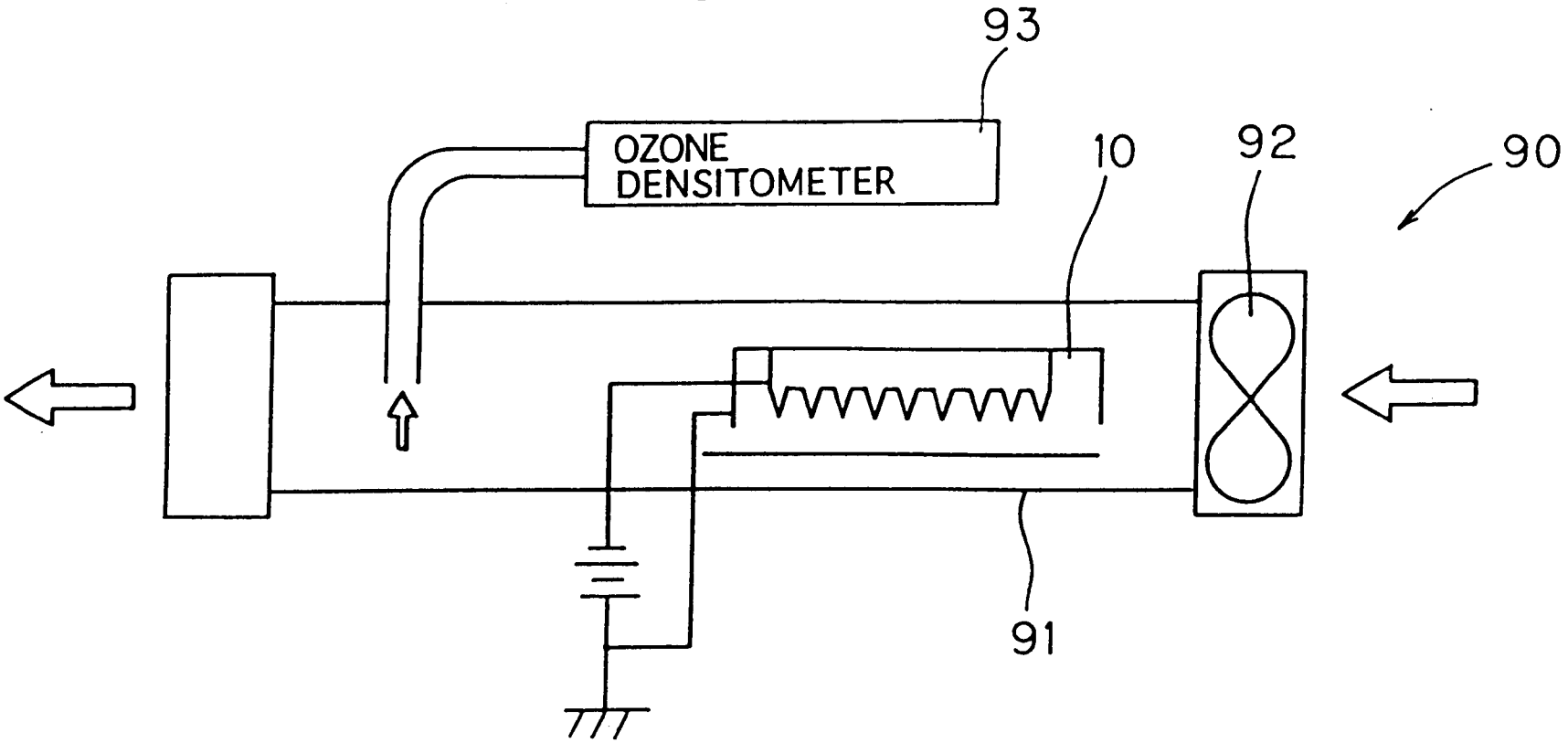
FIG. 10 schematically shows a structure of an ozone measuring device.

The amount of generated ozone was measured by an ozone measuring device 90 shown in FIG. 10. According to this device 90, the corona discharge device 10 was placed in a duct 91, and a high DC voltage was applied to the discharge device 10 while supplying air into the duct 91 by a fan 92. The air passed through the discharge device 10 in the duct 91 was measured by an ozone densitometer 93 to obtain the amount of generated ozone.

(1) Tooth angle θ and amount of generated ozone

The discharge members 1 made of two kinds of materials X and Y were prepared. The material X comprises iron, chromium and nickel. The material Y comprises iron, chromium, nickel and molybdenum. All the prepared members 1 had a constant thickness of 0.05. mm. Various pitches P of 1 mm, 2 mm and 4 mm were employed for each material. Various members 1 having the same pitch but having different tooth angles θ were prepared. These discharge members were placed in the ozone measuring device 90 for measuring the amount of generated ozone. The specification of the device 90 was that the duct 91 had a diameter of 50 mm, an air velocity was 2 m/sec, low temperature and low humidity environment of 20° C. and 34% RH were set, and the discharge current Ic is −800 μA. The results are shown in FIG. 11.

Figure 11:
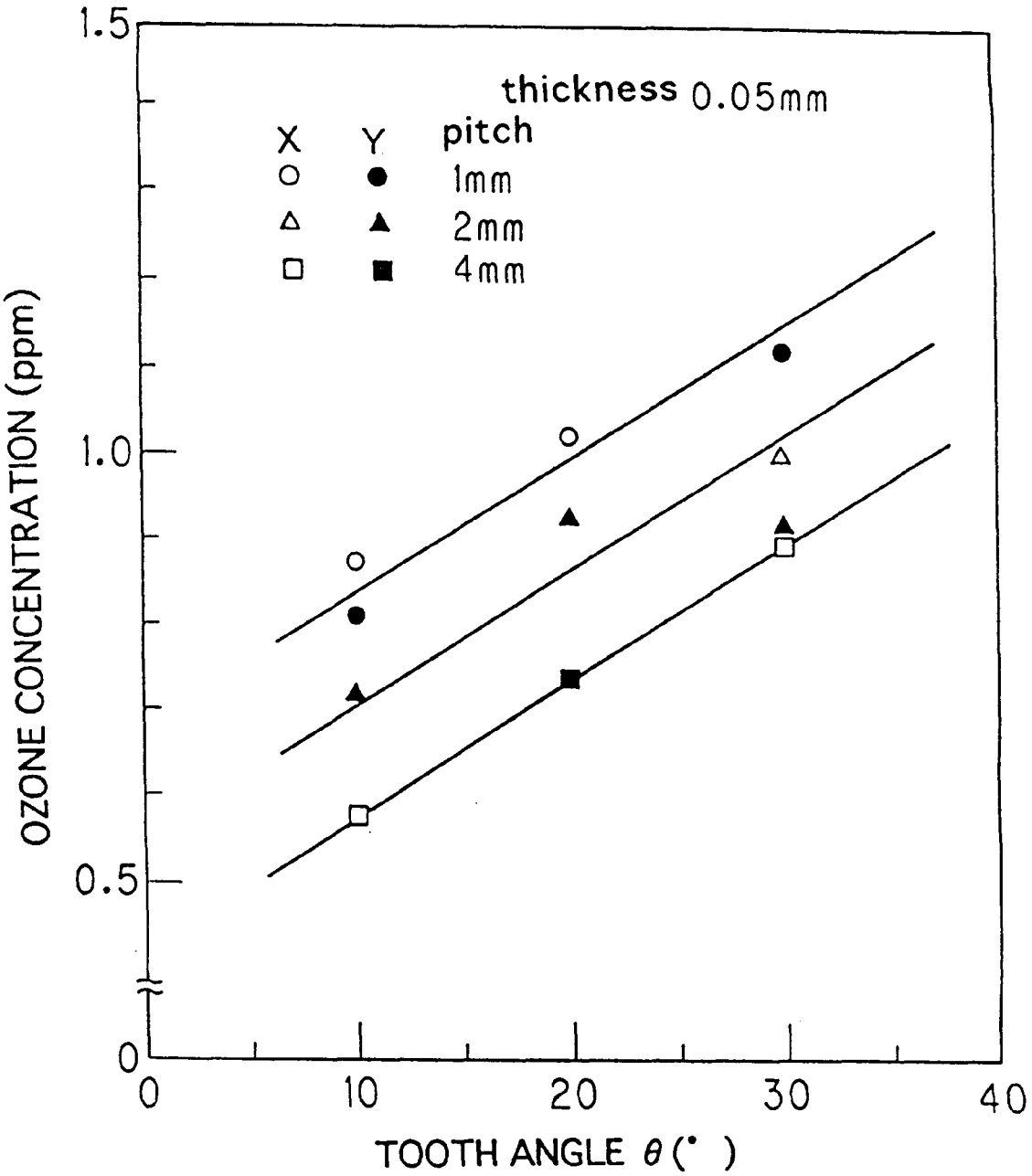
FIG. 11 is a graph showing a relationship between a tooth angle θ of a discharge end of a saw-toothed discharge member and an amount of generated ozone.

As can be seen from FIG. 11, as the tooth angle θ decreases, the amount of generated ozone substantially decreases.

Figure 12:
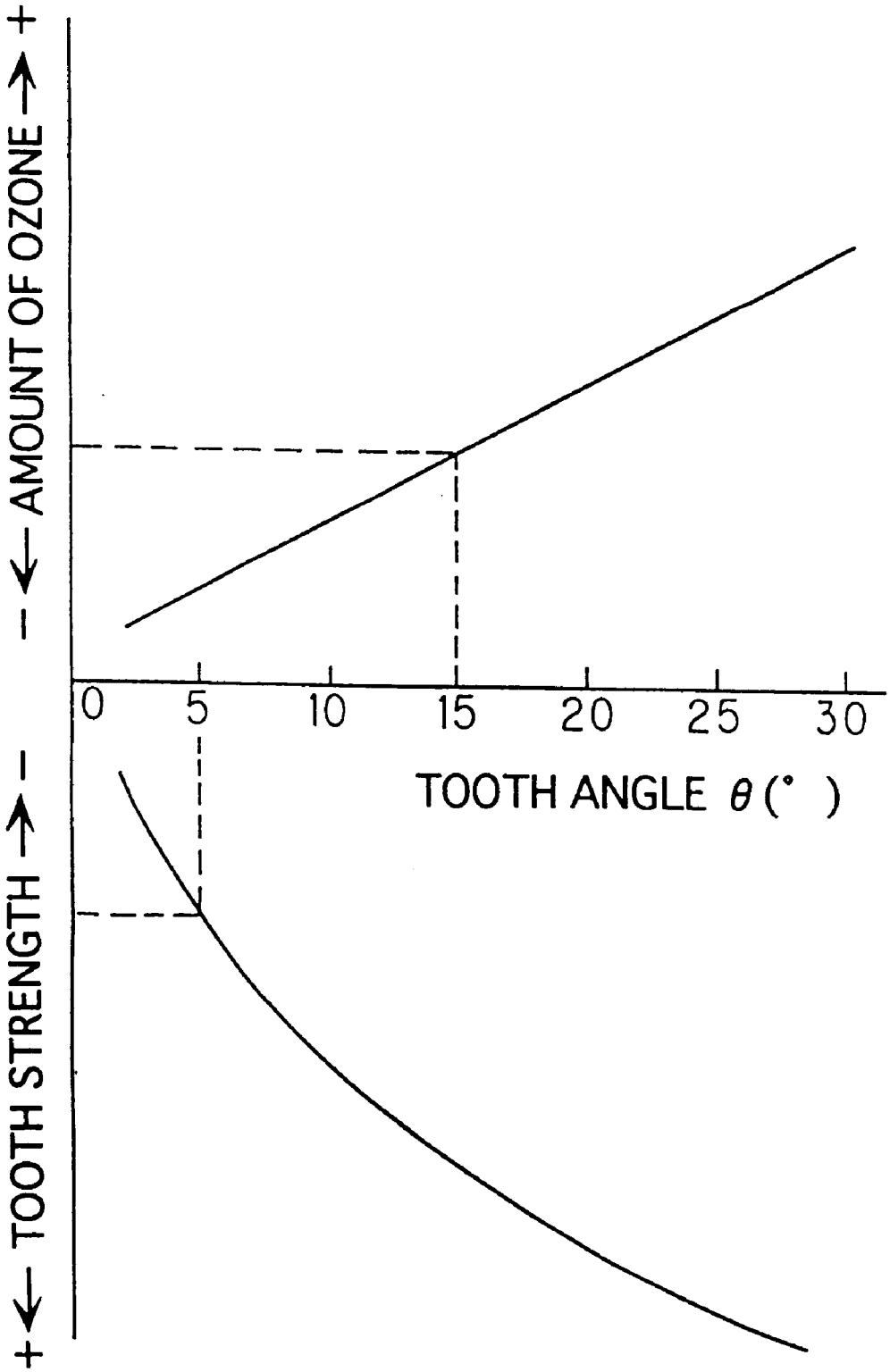
FIG. 12 is a graph showing a relationship between a tooth angle θ of a discharge end and an amount of generated ozone as well as a relationship between a tooth angle θ and a strength of a discharge end portion in a corona discharge device according to the invention employed in a copying machine.

FIG. 12 shows a relationship between the tooth angle θ of the discharge end and the amount of generated ozone as well as a relationship between the tooth angle θ and the strength of the discharge member in the case where a copying machine including an ozone filter having a removable rate of 70% was used, and in the machine, devices of the same type as the corona discharge device 10 were used for charging the photosensitive drum, transferring a toner image onto a transfer sheet and separating the transfer sheet from the photosensitive drum after the transfer. Also in this case, as can be seen from FIG. 12, the smaller the tooth angle θ is, the smaller the amount of generated ozone is.

The specification of this experiment is as follows. If the tooth angle is 15°, the ozone concentration after filtering by the ozone filter can be suppressed to 0.1 ppm, which clears the UL standards.

Each discharge device has the basic configuration shown in FIG. 1, and uses the saw-toothed discharge member 1.

Discharge device for charging the photosensitive drum: Scorotron charger (discharge current=−400 μA)

Discharge device for transfer: Corotron charger (discharge current=−75 μA)

Discharge device for separation: Corotron charger (discharge current=±50 μA

The concentration of ozone was measured in accordance with the UL standards, and specifically, under such conditions that the copying machine placed at a center of an air-conditioned chamber of 27 $m^3$ was operated until the concentration of ozone attained a saturated state.

The result of measured concentration of ozone is as follows (see FIG. 12).

| Tooth angle θ (°) | Measured concentration of ozone (ppm) |
|---|---|
| 5 | 0.02 |
| 10 | 0.06 |
| 15 | 0.10 |
| 20 | 0.15 |
| 25 | 0.20 |

The relationship between the strength of the discharge member and the tooth angle was measured in such a manner that, in each of the discharge devices for charge, transfer and separation, the discharge members having different tooth angles were prepared, and the shapes of the discharge ends having different tooth angles were individually determined after the copying operation of 10000(10K) sheets. The result is shown in the following table, where a circular mark ("o") indicates that change of the shape was not recognized, and a cross mark ("x") indicates that change of the shape was recognized.

Tooth angle θ (°) 2 3 4 5 6 7 8 9 10

After 10 k printing x x x o o o o o o

As can be understood from this result of experiment (and also from FIG. 12), if the tooth angle is smaller than 5°, change of the shape of the discharge end occurred, so that uniform charging could not be performed. The reason of this is probably that if the tooth angle is excessively small, a sufficient strength cannot be ensured at the discharge end portion, so that the discharge end portion deforms due to the heat at the discharge point in the printing operation. Accordingly, the tooth angle must be set in view of not only the amount of generated ozone but also the strength of the discharge end portion, and more specifically, it is desired that the tooth angle is set to a value (e.g., from 5° to 30°, and preferably, not more than 15°) which ensures the strength preventing deformation of the discharge end by the discharge and reduces the amount of generated ozone.

Figure 13:
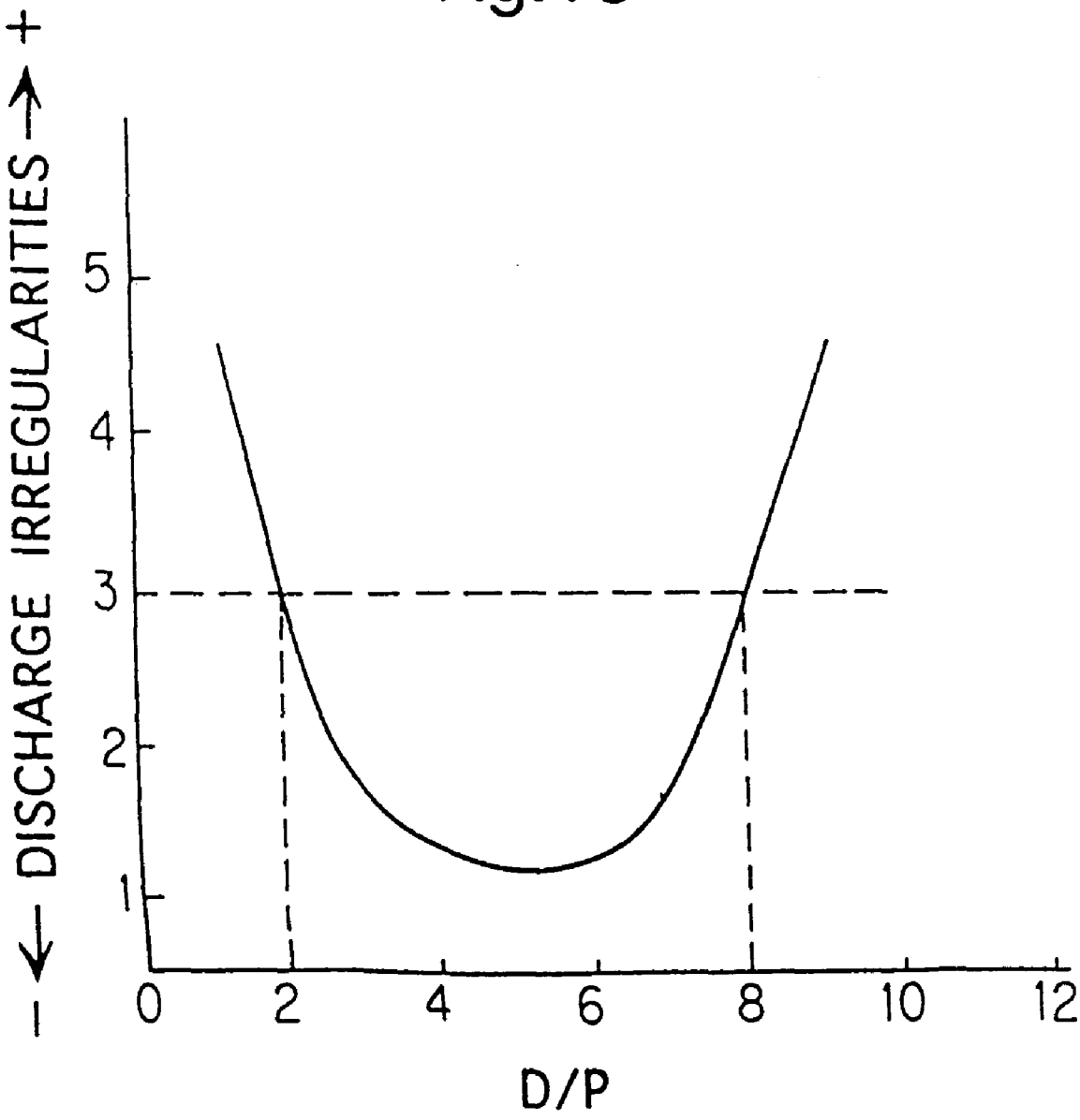
FIG. 13 is a graph showing a relationship among a discharge end pitch P of a discharge member, a distance D between a discharge end and a charge receiving member, and discharge irregularities.

(2) Discharge end pitch P, distance D between the charge receiving member and the discharge end, and irregular discharge A relationship between the irregular discharge and D/P, which is a ratio of the discharge end P (mm) and the discharge gap D (mm), was determined and the result shown in FIG. 13 was obtained. According to the result, if D/P was smaller than 2 or larger than 8, irregular discharge which could not be practically neglectable, occurred. If D/P was between 2 and 8, the irregular discharge was suppressed, so that the charge receiving member could be charged substantially uniformly. If the D/P was between 4 and 6, the irregular discharge was further suppressed.

The irregular discharge was evaluated in accordance with five ranks 1–5 (see FIG. 13). Thus, the influence applied to the obtained image was ranked in accordance with the following standards.

Irregular discharge rank 5: irregularities are clearly recognized in the image.

Irregular discharge rank 4: irregularities are visually recognized in the image.

Irregular discharge rank 3: irregularities are not visually recognized in the image but can be recognized with a measuring equipment.

Irregular discharge rank 2: irregularities are hardly recognized even with a measuring equipment.

Irregular discharge rank 1: irregularities do not exist.

An optimum value of D/P is selected to attain the irregular discharge rank 3 or better rank than that according to which irregularities in the image quality are not visually recognized.

(3) Thickness of the saw-toothed portion 12 (discharge end portion) and amount of generated ozone The discharge members 1 made of two kinds of materials X and Y were prepared. The material X comprises iron, chromium and nickel. The material Y comprises iron, chromium, nickel and molybdenum. In connection with each of the materials X and Y, the discharge members 1 having various pitches P of 1 mm, 2 mm and 4 mm were employed. In connection with each of the pitches, the discharge ends having various tooth angles were also prepared, and also the discharge members having various thicknesses were prepared. These discharge members were placed in the ozone measuring device 90 for measuring the amount of generated ozone. The specification of the device 90 was that the duct 91 had a diameter of 50 mm, an air velocity was 2 m/sec, low temperature and low humidity environment was set, and the discharge current Ic is −800 $\mu$A. The results are shown in FIG. 14.

Figure 14:
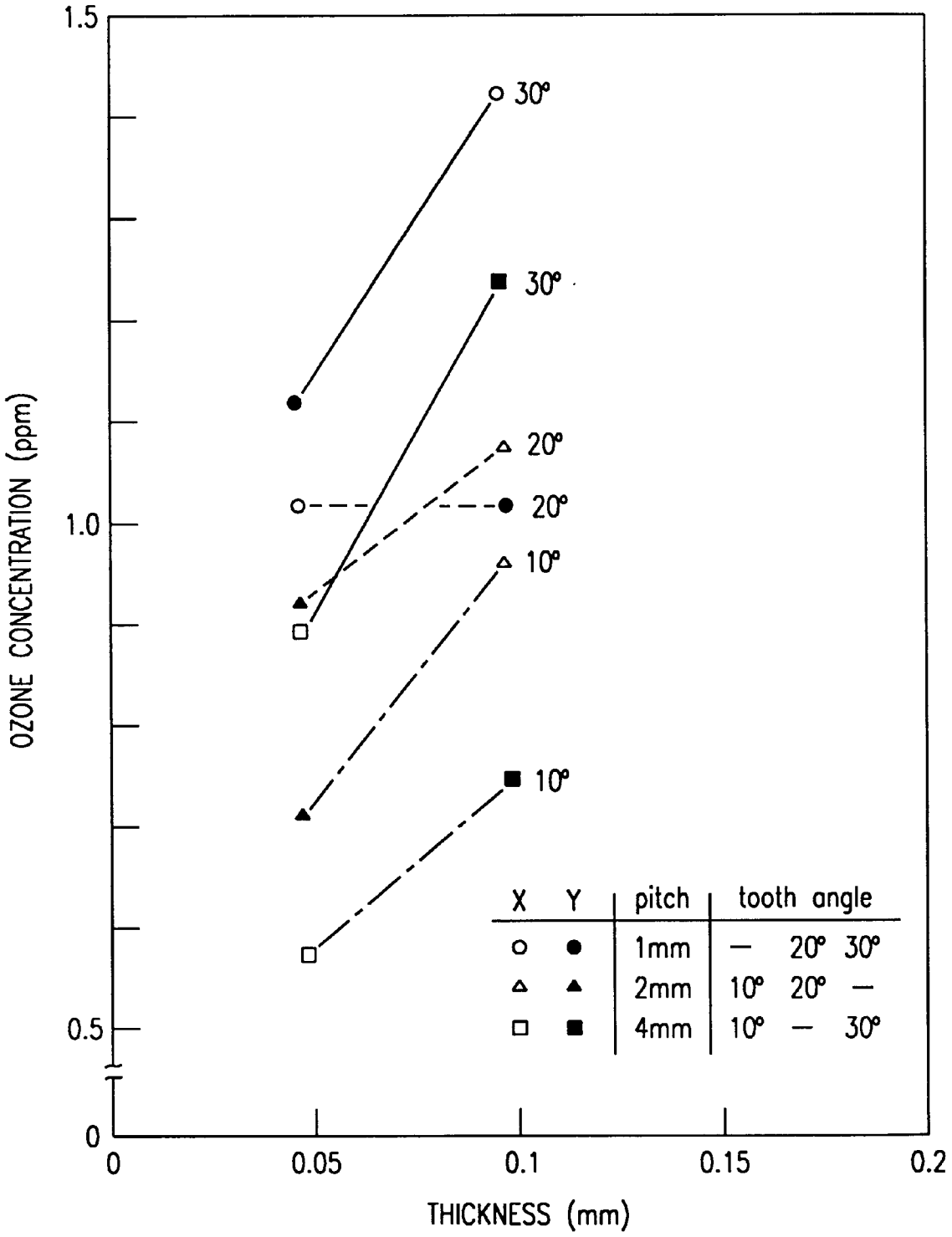
FIG. 14 is a graph showing a relationship between a thickness of a discharge end portion of a saw-toothed discharge member and an amount of generated ozone.

As can be seen from FIG. 14, as the thickness decreases, the amount of generated ozone substantially decreases.

Figure 15:
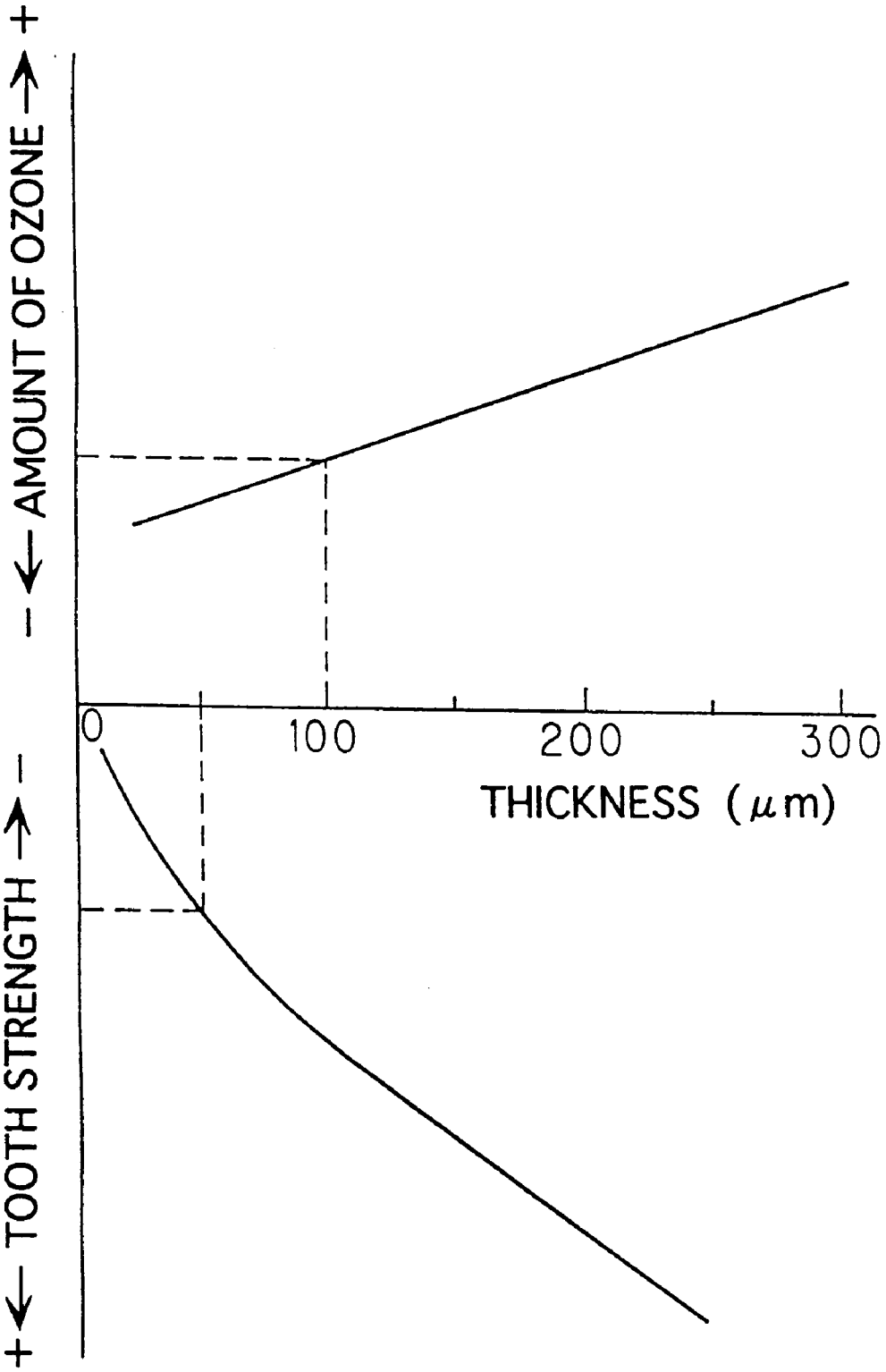
FIG. 15 is a graph showing a relationship between a thickness of a discharge end portion of a discharge member and an amount of generated ozone as well as a relationship between a thickness and a strength of a discharge end portion in a corona discharge device according to the invention employed in a copying machine.

FIG. 15 shows a relationship between the thickness of the discharge end portion and the amount of generated ozone as well as a relationship between the thickness and the strength of the discharge member in the case where a copying machine including an ozone filter having a removable rate of 70% was used, and in the machine, devices of the same type as the corona discharge device 10 were used for charging the photosensitive drum, transferring a toner image onto a transfer sheet and separating the transfer sheet from the photosensitive drum after the transfer. The concentration of ozone was measured in accordance with the UL standards, and specifically, under such conditions that the copying machine placed at a center of an air-conditioned chamber of 27 $m^3$ was operated until the concentration of ozone attained a saturated state. As can be seen from FIG. 15, as the thickness decreases, the amount of generated ozone decreases also in this case.

With respect to coating of the portion including the discharge end 11 of the discharge member 1 with a material having a high electric resistance, and others In connection with this, an experiment was performed with a corona discharge device 100 which had the same basic configuration as the corona discharge device 10 in FIG. 1 and included the following discharge member.

Discharge Member 1

Method of formation: etching

Material: stainless steel

Thickness: 0.05 mm

Discharge end pitch: 2 mm

Tooth angle θ of saw-toothed portion 12: 20°

Coating Film 13 of Discharge End Portion (see FIG. 1(C))

Method of formation: vapor deposition with ion beam assist

Material: $SiO_2$

Thickness: 0.1 $\mu$m

As an example for comparison, the experiment was performed with devices DA and DB for comparison. The device DA had the same basic configuration as the corona discharge device 10, and had the same discharge member as the aforementioned discharge member 1 except for that it was not coated with the coating film. The device DB was of the conventional wire type, but used the discharge wire made of a tungsten wire of 50 $\mu$m in diameter.

The amount of generated ozone was measured with the device shown in FIG. 10. The duct 91 in which the discharge device was placed had a diameter of 50 mm, air was supplied at a velocity of 2 m/sec, and a DC high voltage was applied to the discharge member. The air which passed through the discharge device in the duct 91 was measured with the ozone densitometer 93.

Figure 16:
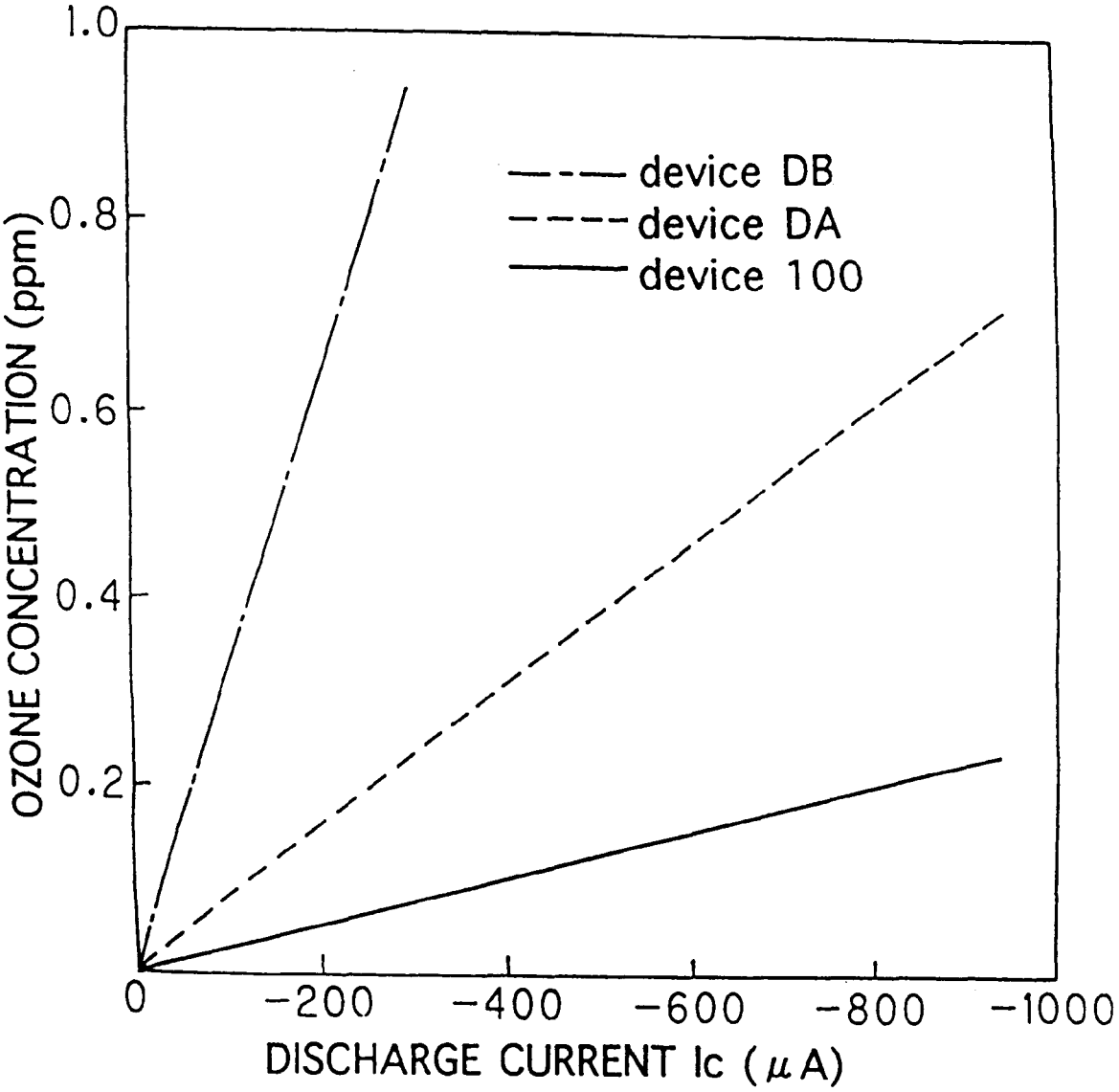
FIG. 16 is a graph showing a relationship between discharge currents and an amount of generated ozone in a discharge device including a discharge end portion coated with a high resistance material, a discharge device not provided with a coating film, and a discharge device of a wire electrode type.

FIG. 16 shows the result in the case where the discharge current was varied up to 1 mA. As can be seen from FIG. 16, a ratio of about 1:3:12 was obtained among the amounts of ozone generated by the discharge device 100 according to the invention, and the two devices DA and DB for comparison with the same discharge current. Thus, the discharge device 100 using the discharge member including the coated discharge end portions can reduce the amount of generated ozone by about 1/12 as compared with the discharge device DB of the conventional wire type.

Figure 17:
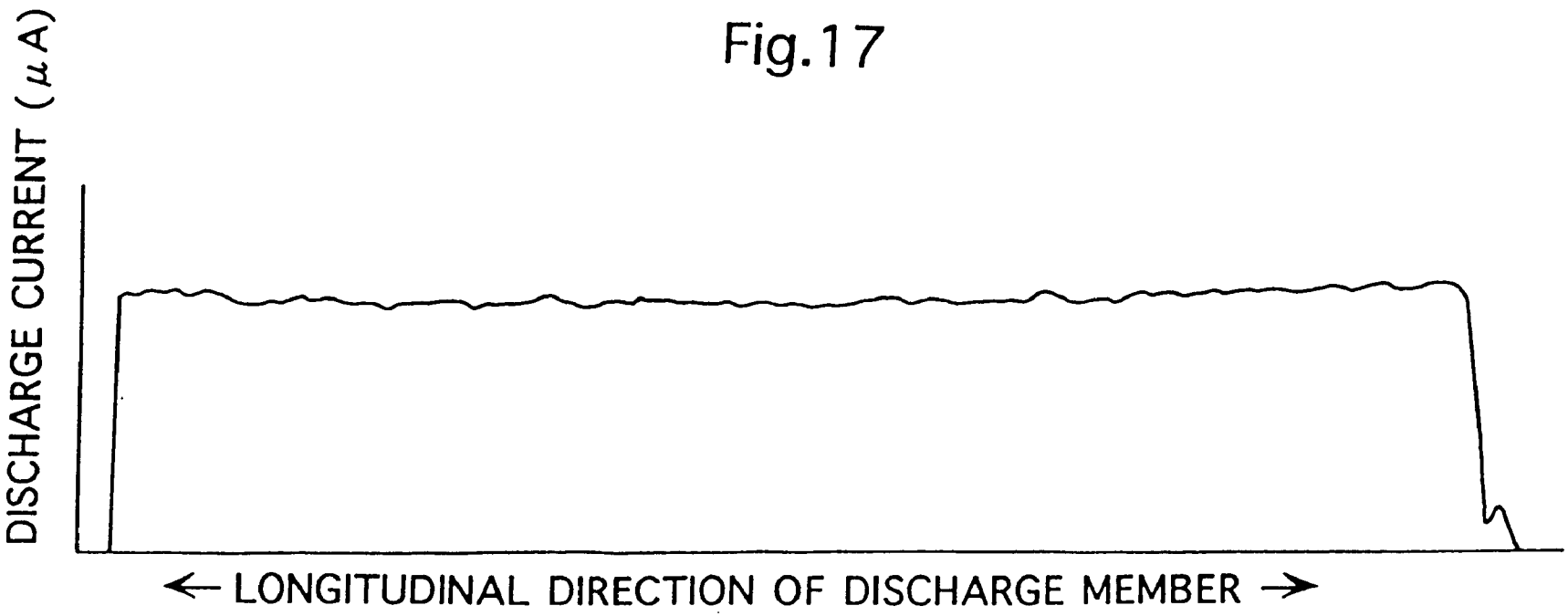
FIG. 17 is a graph showing irregular discharge in a longitudinal direction of a discharge member having discharge end portions coated with a high resistance material before use.
Figure 18:
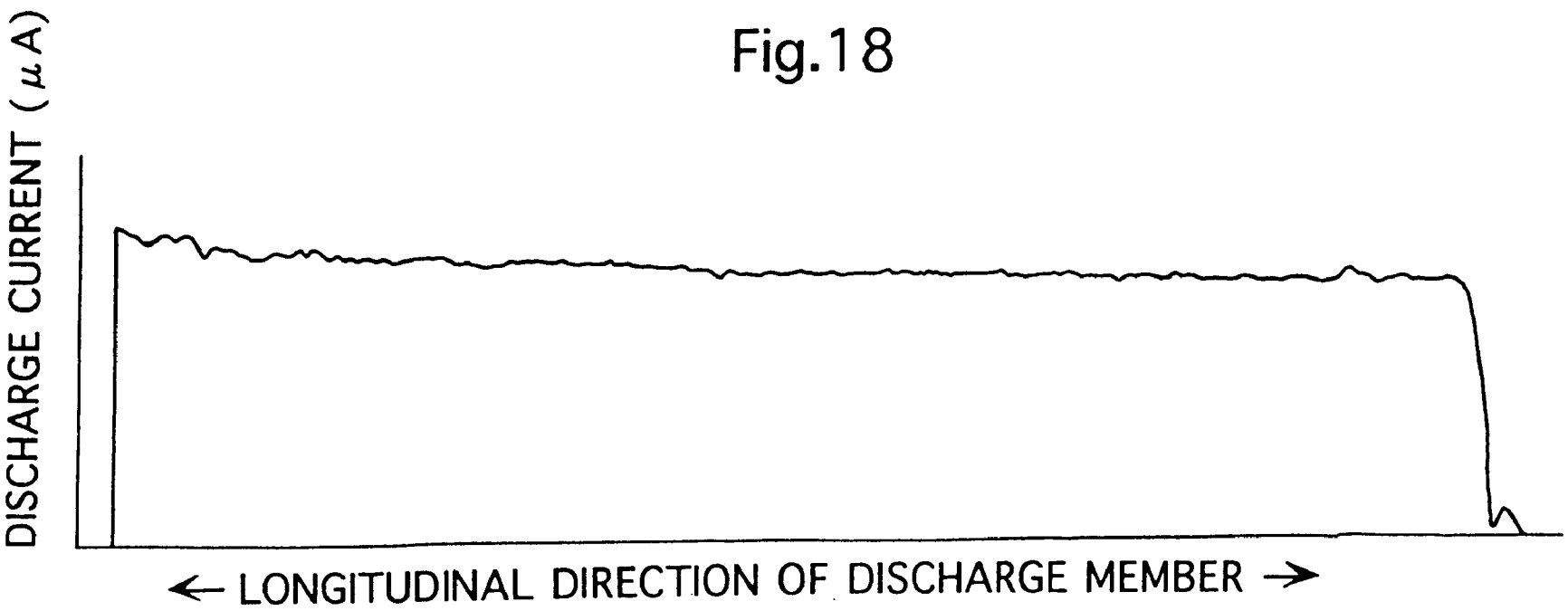
FIG. 18 is a graph showing irregular discharge in the longitudinal direction of the discharge member shown in FIG. 17 after long-time discharge.
Figure 19:
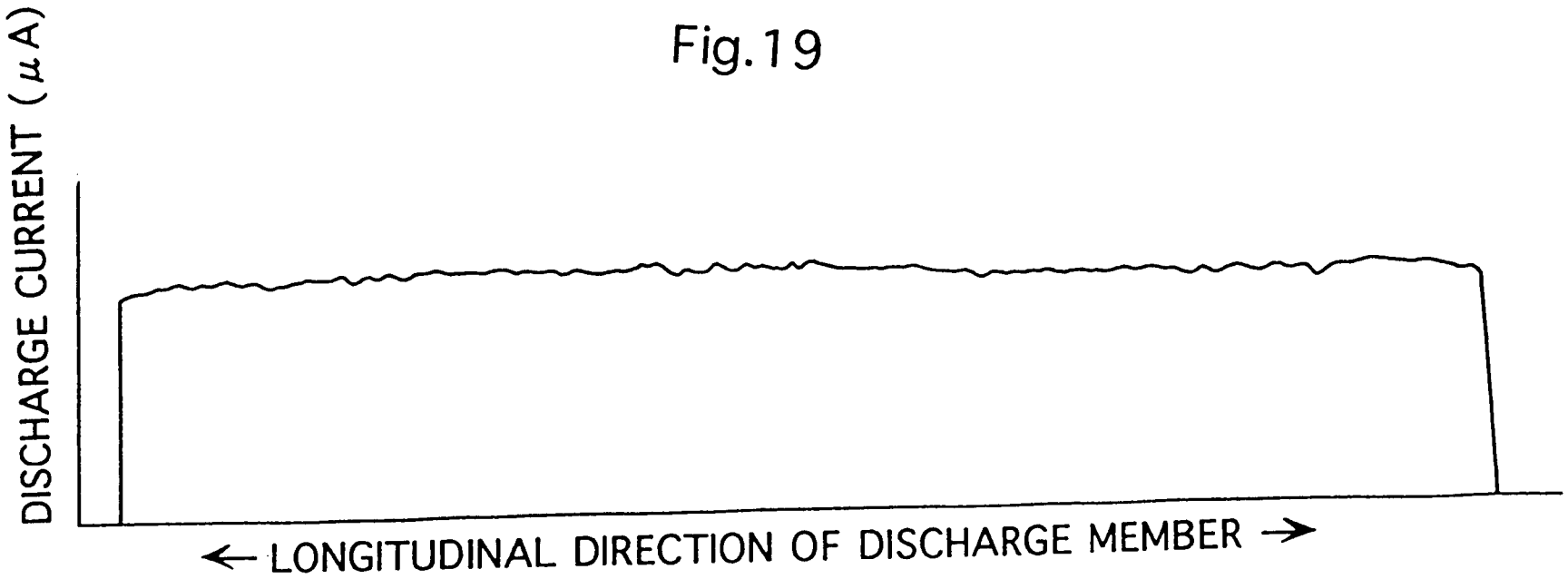
FIG. 19 is a graph showing irregular discharge in a longitudinal direction of a discharge member having discharge end portions not coated with a high resistance material before use.
Figure 20:
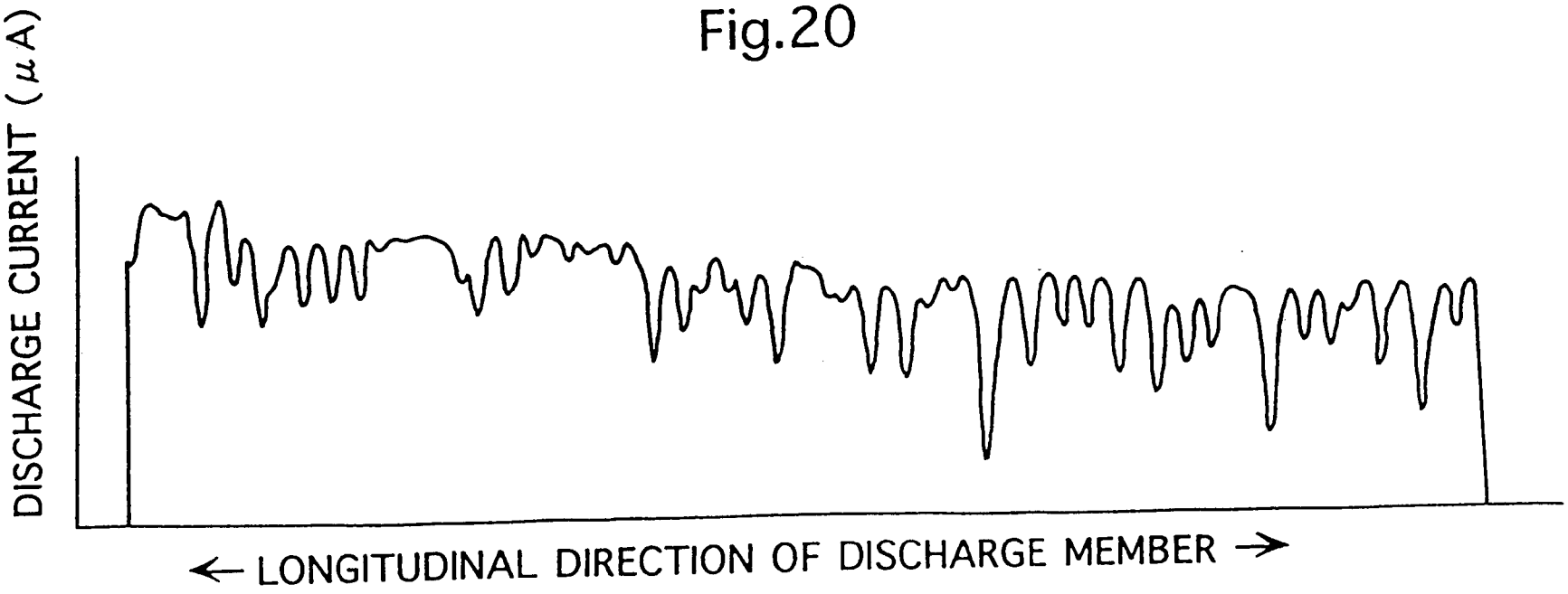
FIG. 20 is a graph showing irregular discharge in a longitudinal direction of a discharge member shown in FIG. 19 after long-time discharge.

Corona discharge was performed by the discharge device 100 and the device DA for comparison for measuring the discharge currents flowing from longitudinally various portions of the discharge members toward the charge receiving members. The result is shown in FIGS. 17 and 19. The discharge currents were also measured after the discharge was performed by the discharge device 100 and the device DA for comparison for a long time. The result is shown in FIGS. 18 and 20. As can be seen from these figures, the device DA for comparison including the discharge member 1 not coated with the highly resistive material caused irregular discharge currents after a long-time discharge as shown in FIG. 20. Meanwhile, the discharge device 100 according to the invention hardly caused the irregular discharge currents even after the long-time discharge as shown in FIG. 18. Thus, the durability and the discharge stability are improved by the fact that the discharge end portion is coated with the material having a high resistance.

With respect to voltage applied to discharge member and others

The corona discharge device 10 according to the invention shown in FIG. 1 was placed in the duct 91 of the ozone measuring device 90 shown in FIG. 10, and the power was supplied to the saw-toothed discharge member 1 for measuring the amount of generated ozone. A device for comparison, which was of the conventional wire type, was prepared for measuring the amount of ozone in the similar manner.

Figure 21:
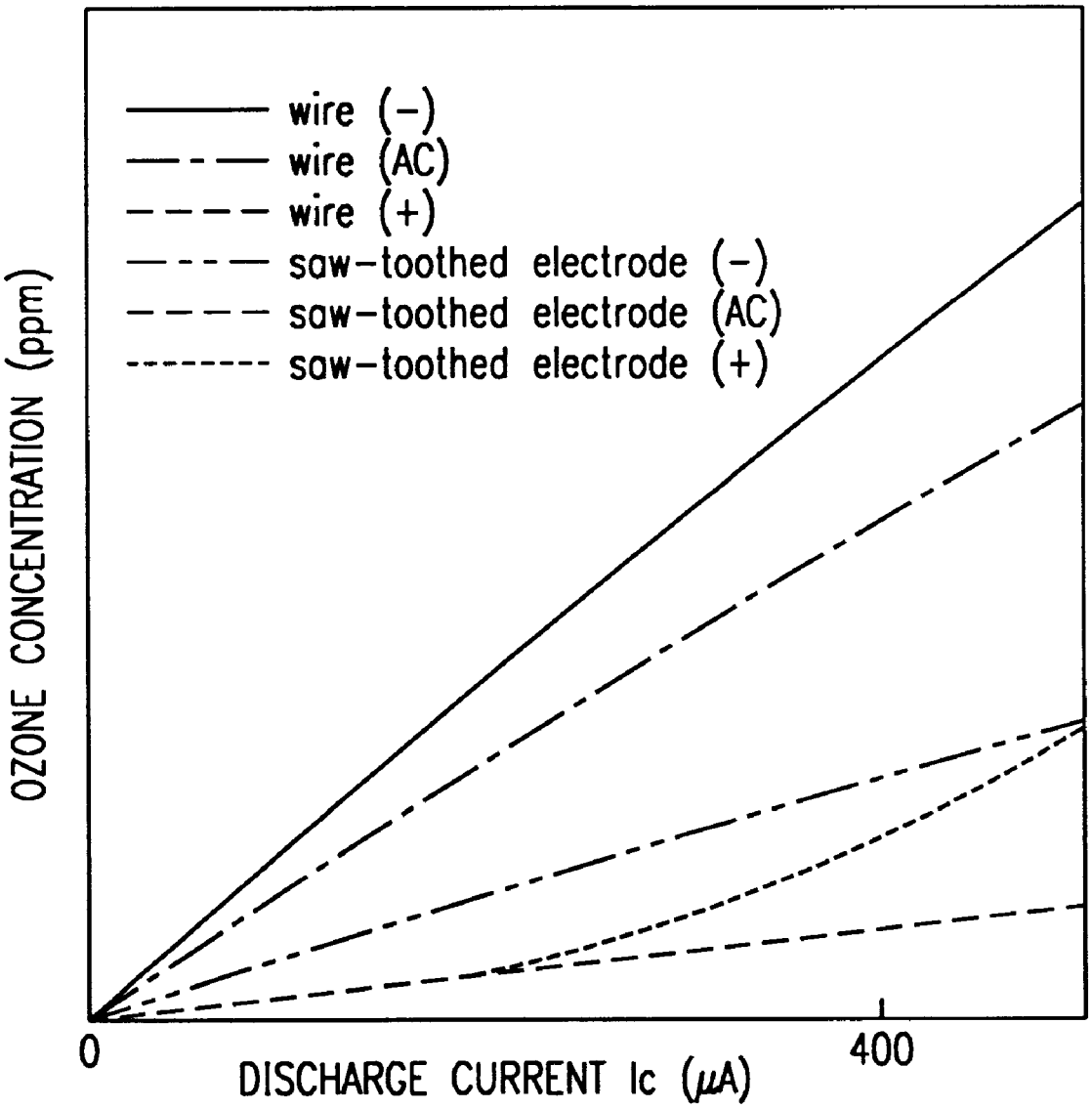
FIG. 21 is a graph showing a relationship between a discharge current and an amount of generated ozone in the case of application of a DC voltage or an AC voltage in a wire electrode discharge device and a discharge device provided with a saw-toothed discharge member.

Each of the device of the invention and the device for comparison was selectively supplied with a positive DC voltage, a negative DC voltage and an AC voltage to perform (+) discharge, (−) discharge and AC discharge for measuring the amount of ozone, respectively. The result is shown in FIG. 21.

The ratio of amounts of ozone generated by the most general discharge device, i.e., the discharge device provided with the wire electrode was as follows. Assuming that the amount of generated ozone was 1 when the discharge current of 400 $\mu$A flows with the positive DC voltage, the ratio of amounts of generated ozone was expressed nearly as (−) discharge: AC discharge: (+) discharge=7:4:1. The amount of ozone generated by the AC discharge was equal to the sum of amounts of generated ozone with (+) component and (−) component, i.e., 7/2+1/2=4. Meanwhile, according to the discharge device provided with the saw-toothed discharge member, the ratio of amounts of generated ozone was expressed nearly as (−) discharge: AC discharge: (+) discharge=2.5:1: from 1 to 2.5, and thus the amount of generated ozone was minimum with the AC.

It can be understood from the above that the amount of generated ozone can be effectively reduced if the discharge member has the saw-toothed discharge end and is supplied with a voltage having an AC component for corona discharge.

Figure 22:
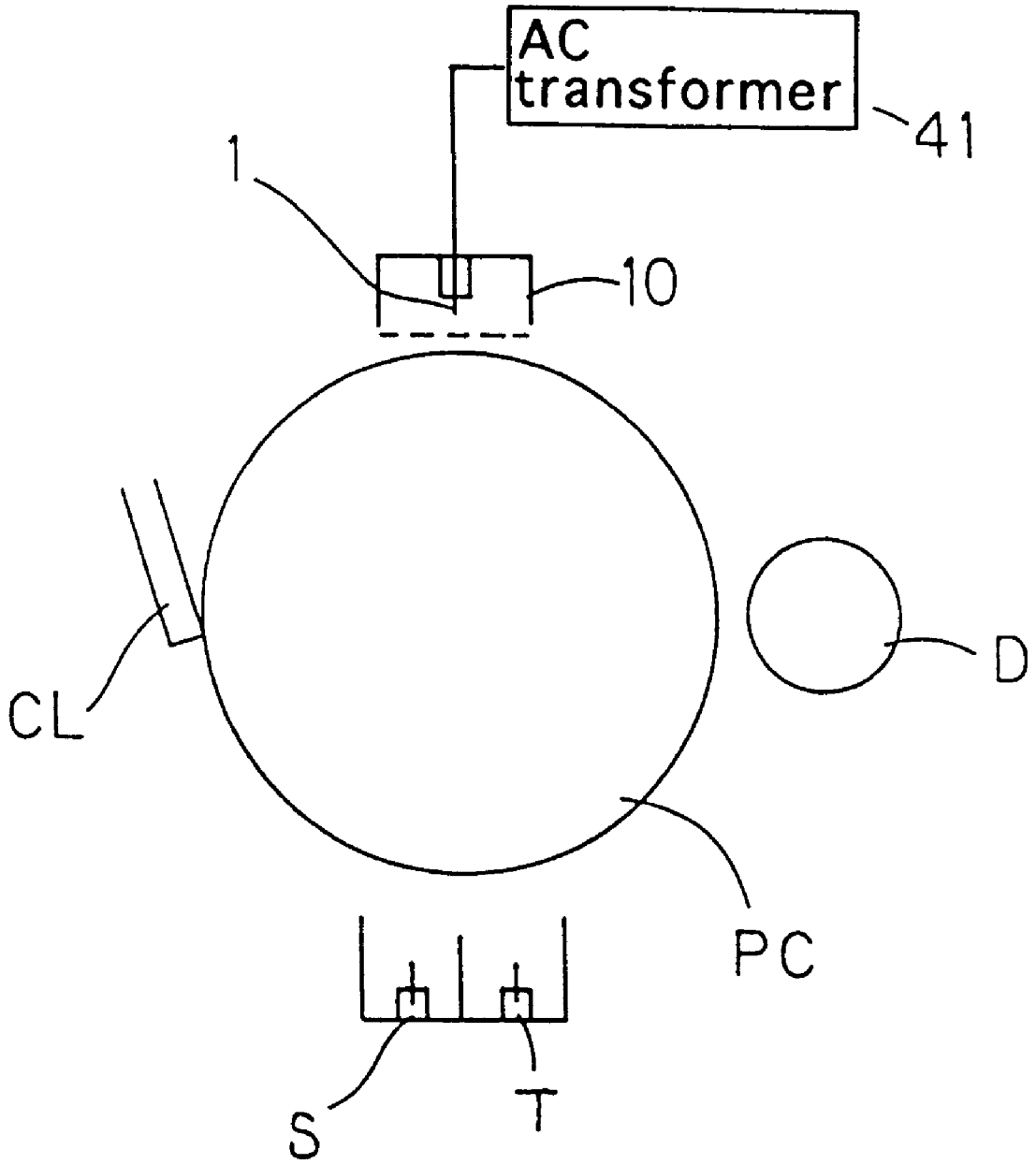
FIG. 22 shows an example of a power supply for a discharge device according to the invention.
Figure 23:
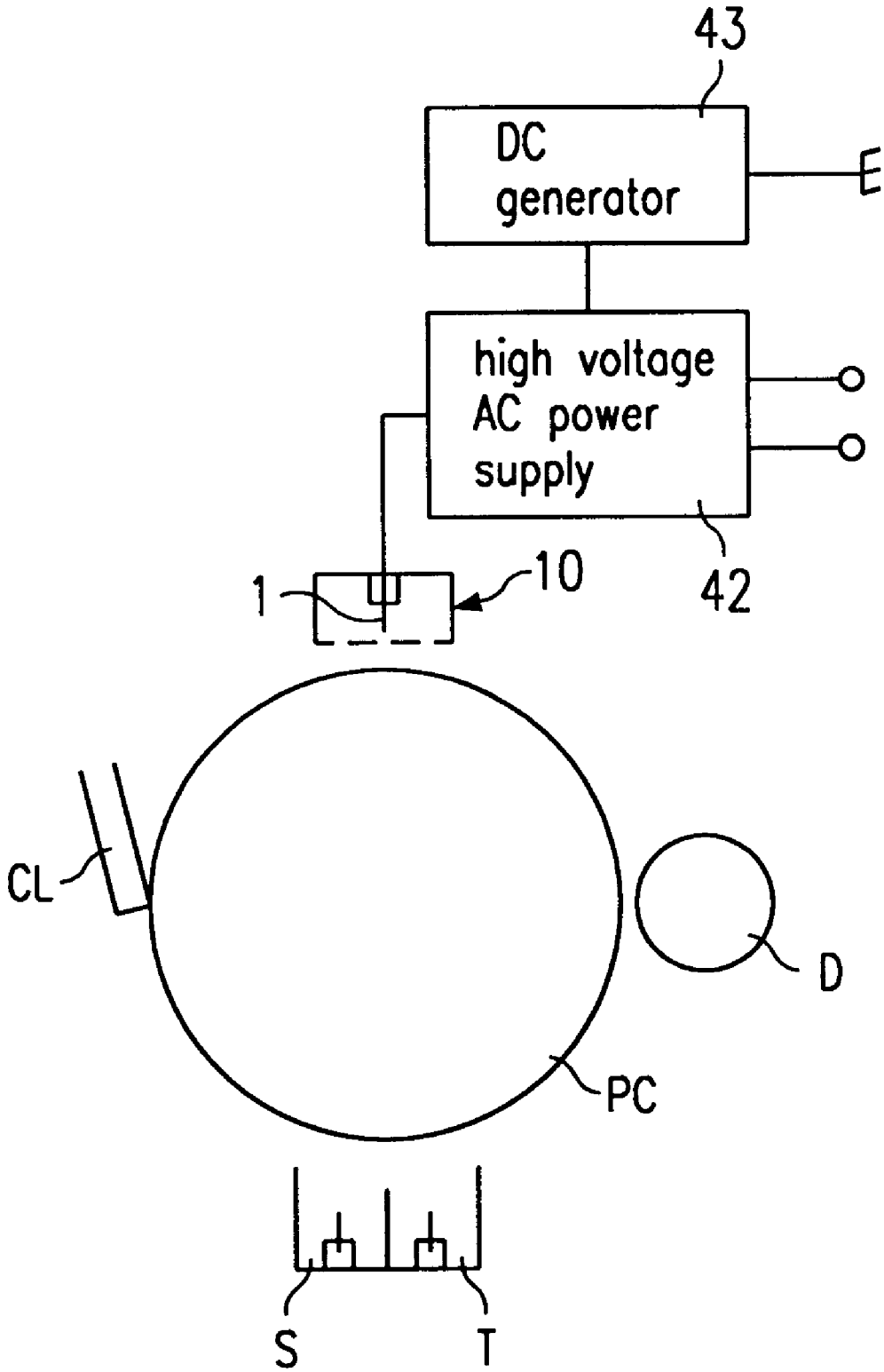
FIG. 23 shows another example of a power supply for a discharge device according to the invention.
Figure 24:
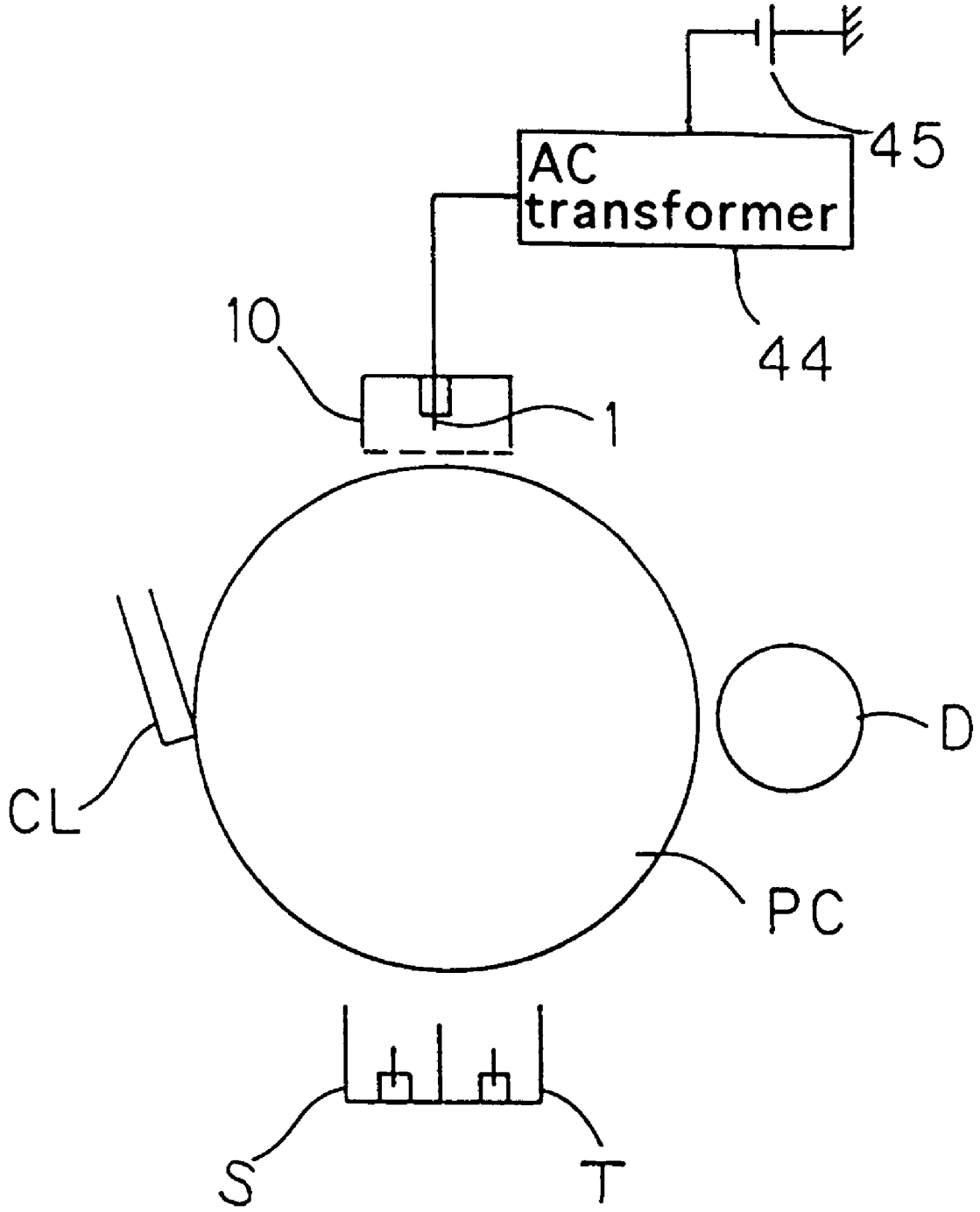
FIG. 24 shows still another example of a power supply for a discharge device according to the invention.

FIGS. 22, 23 and 24 show examples of the power supply 4 for such a case that the corona discharge device 10 is used for charging the photosensitive drum PC of a copying machine and the discharge member 1 of the device is supplied with the discharge voltage containing an AC voltage component. In FIG. 22, an AC transformer 41 is used for the corona discharge. In FIG. 23, an AC high voltage power supply 42 and a DC generator 43 are used for superposing an AC voltage on a DC application voltage. In FIG. 24, an AC transformer 44 and a DC power supply 45 are used for superposing an AC voltage on a DC application voltage. In the embodiments in FIGS. 23 and 24, charging can be performed efficiently while reducing the amount of generated ozone owing to the application of the AC.

In FIGS. 22 to 24, "T" indicates a transfer charger, and "S" indicates a separation charger. These also employ the corona discharge devices provided with the discharge member having the sharp discharge ends. These chargers may employ the same power supply as the discharge device 10. In the figures, "D" indicates a developing device, and "CL" indicates a cleaner for removing residual toner.

Finally, FIGS. 25 to 28 show the amount of ozone generated by the discharge in the cases where the discharge device of the type shown in FIG. 1 and the device for comparison were used for charging the photosensitive drum of a copying machine under the following conditions.

Discharge device according to the invention

The discharge member 1 is made of a stainless steel plate of 0.5 mm in thickness, and has such configurations that the discharge end pitch P is 2 mm, the tooth angle θ of the saw-toothed portion 12 is 20°, and the saw-toothed portion 12 is coated with an $SiO_2$ film of 0.1 μm in thickness. The distance D from the discharge end 11 to the surface of the photosensitive drum is 6 mm, and a distance (skirt length) of 4 mm is set from the discharge end 11 to the end of each stabilizer 3 in a direction from the discharge end toward the surface of the surface of the photosensitive member.

Device for comparison

The device has the same structures as the device of the invention except for that the coating film of $SiO_2$ is not employed.

The amount of generated ozone was measured by the device 90 in FIG. 10 having the duct 91 of 50 mm in diameter with the air velocity of 2 m/sec, the temperature of 20° C. and the humidity of 34% RH.

Figure 25:
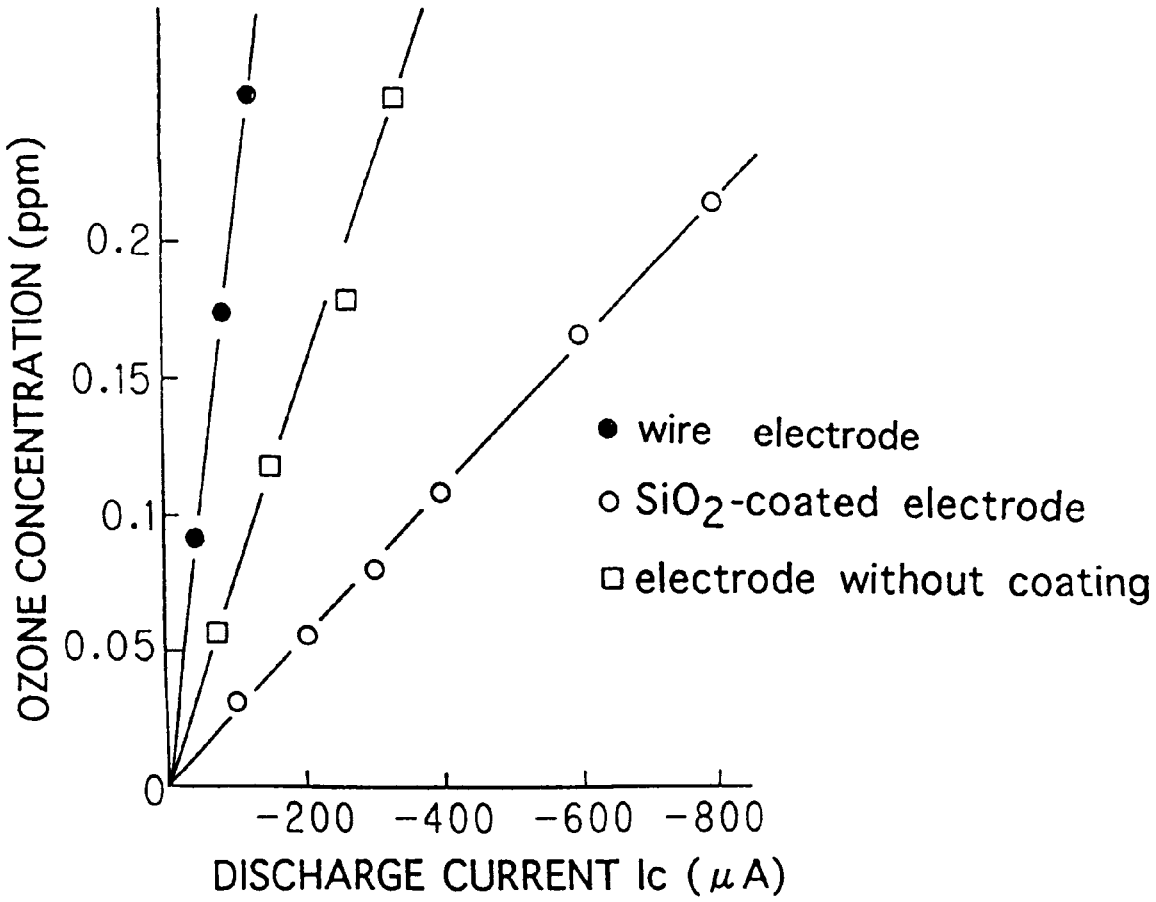
FIG. 25 is a graph showing an amount of generated ozone in the cases where discharge end portions of a discharge member are coated and are not coated with a high resistance material.

FIG. 25 shows Ic (discharge current) and the amount of generated ozone when the (−) discharge was performed. From this, it can be understood that the coating with $SiO_2$ effectively reduces the amount of ozone even in the (−) discharge operation.

FIG. 25 also shows the relationship between the amount of generated ozone and the discharge current under the conventional device of wire electrode type.

Figure 26:
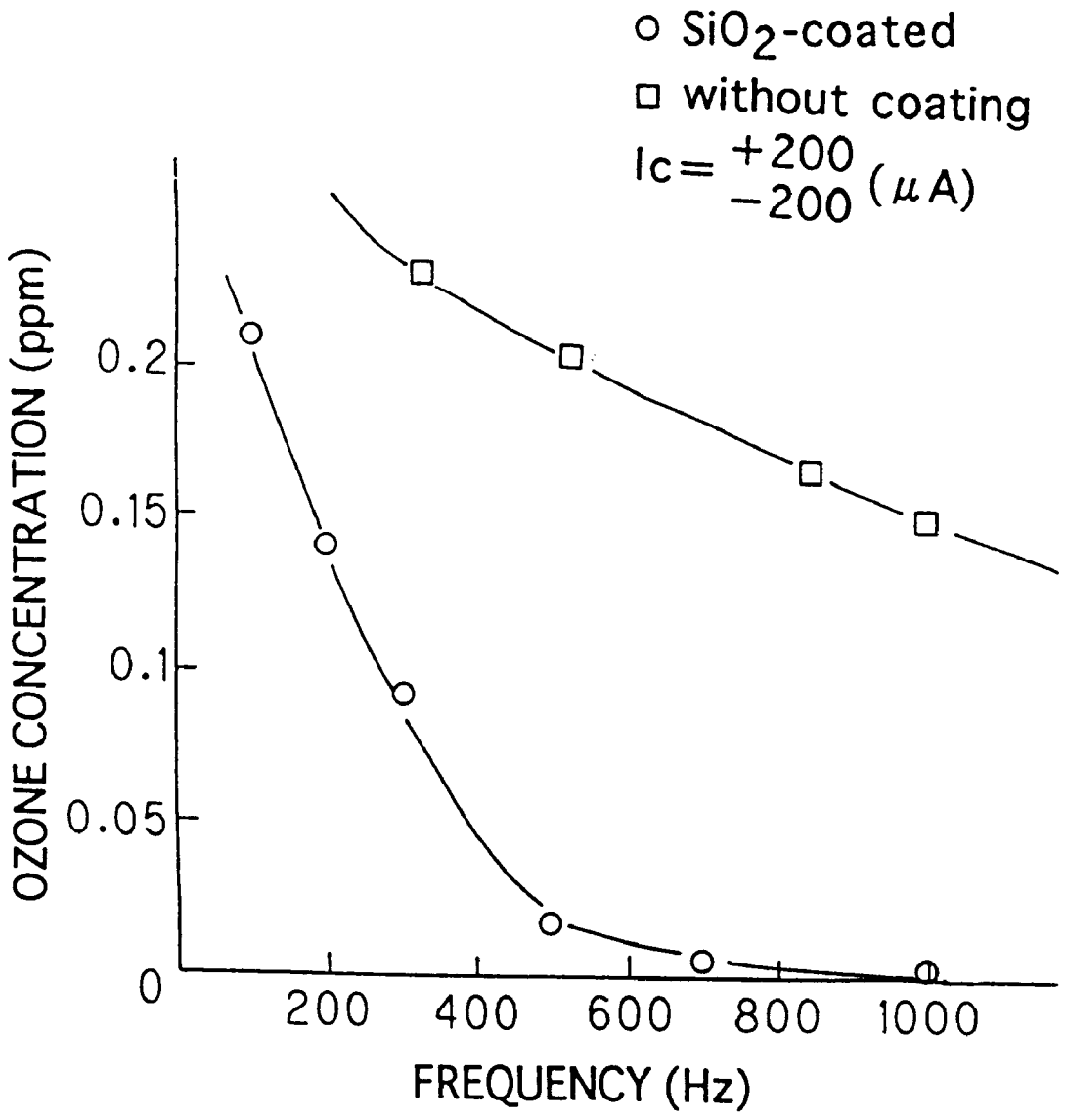
FIG. 26 is a graph showing a relationship between a frequency of an applied high-frequency voltage and an amount of generated ozone in the cases where discharge end portions of a discharge member are coated and are not coated with a high resistance material.

FIG. 26 shows the amount of ozone generated when the discharge was performed with the AC voltage, the discharge current Ic of ±200 μA and various frequencies. It can be seen therefrom that, as the frequency increases, the amount of generated ozone decreases, and that the $SiO_2$ coating can remarkably reduce the amount of generated ozone as compared with the structure without coating.

Figure 27:
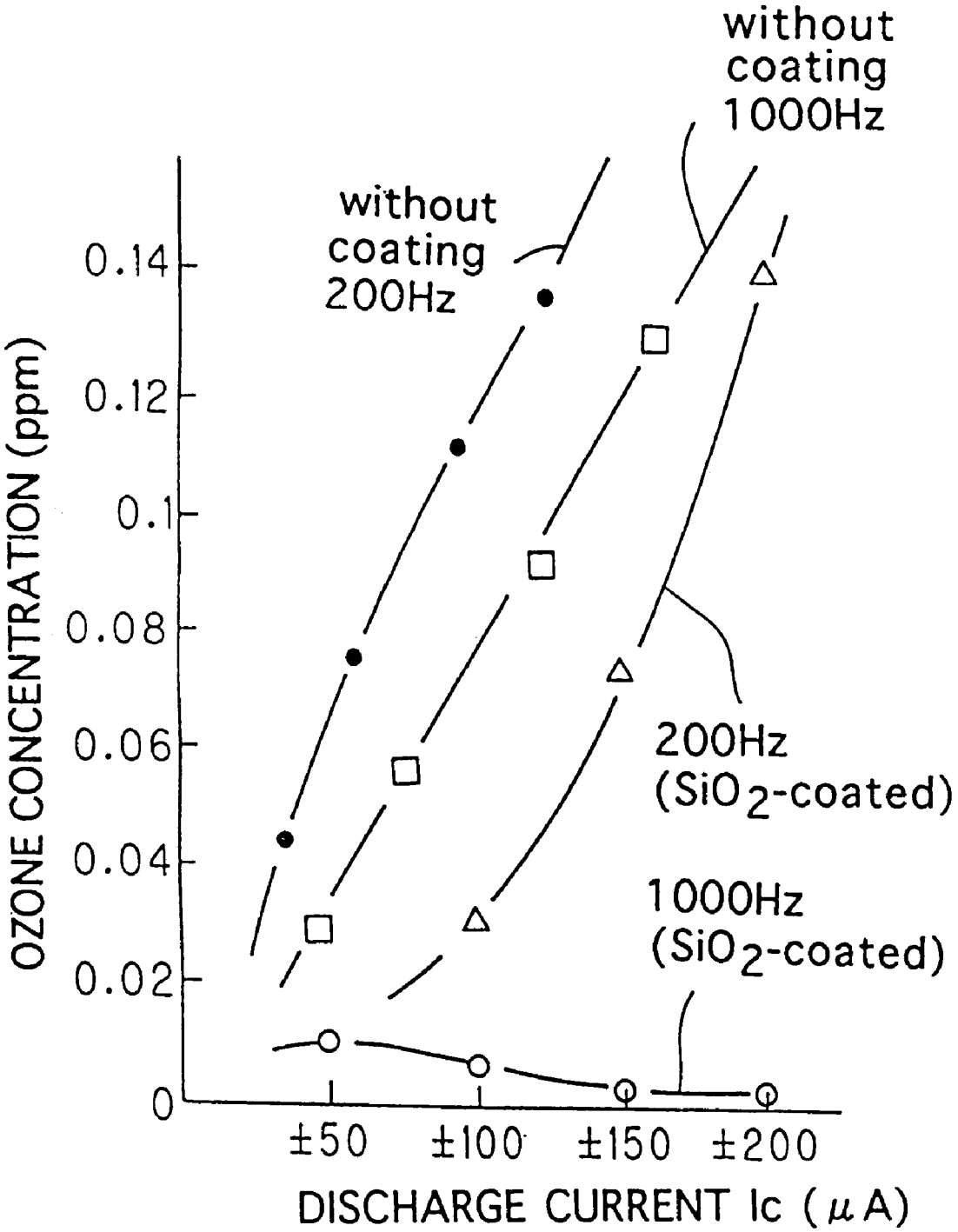
FIG. 27 is a graph showing an amount of generated ozone as a function of a discharge current when an (AC) discharge is performed.

FIG. 27 shows a result when the (AC) discharge was performed with the discharge current Ic of various values. The sample values of frequency were 200 Hz and 1000 Hz. It can be found that the $SiO_2$ coating can remarkably reduce the amount of generated ozone as compared with the structure without coating, that, in connection with the applied high frequency, the frequency of 1000 Hz can reduce the amount of generated ozone as compared with the value of 200 Hz, and that the amount of generated ozone is remarkably reduced when the $SiO_2$ coating is employed and the AC discharge is performed with 1000 Hz.

Figure 28:
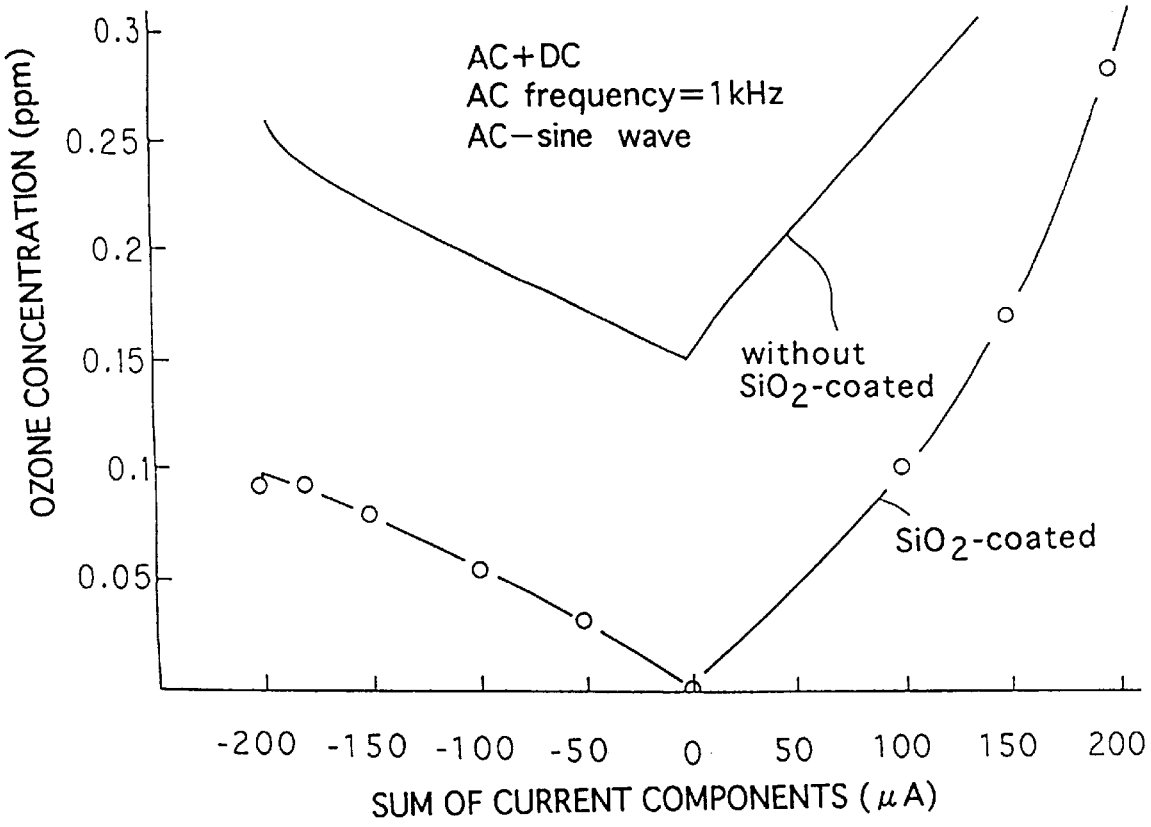
FIG. 28 is a graph showing an amount of generated ozone as a function of a sum of current components of an AC voltage.

FIG. 28 shows the amount of ozone generated by the device with and without $SiO_2$ coating as a function of the sum of current components of the AC voltage. Here, both of the positive and negative current components were set in a range from 0 to ±200 μA. If the sum of the positive and negative current components was within a range from −200 μA to +100 μA, the amount of generated ozone was small, and the amount of generated ozone decreased as the sum of the current components approached 0.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A corona discharge device used in an electrophotographic image forming apparatus comprising:

a discharge member having sharp discharge ends; and means for applying to said discharge member a discharge voltage containing at least an AC voltage component.

2. The corona discharge device according to claim 1, wherein at least each discharge end portion including said discharge end of said discharge member is made of an electrically conductive material containing nickel in a range from 8% to 15% and chromium in a range from 16% to 20%.

3. The corona discharge device according to claim 2, wherein said electrically conductive material forming said discharge end portion contains molybdenum in a range from 2% to 3%.

4. The corona discharge device according to claim 1, wherein at least each discharge end portion including said discharge end of said discharge member is coated with a material having a high electric resistance.

5. The corona discharge device according to claim 1, wherein said discharge member includes a plurality of sharp discharge ends arranged in a row, and a distance D (mm) of a space between said discharge end and a charge receiving member to be charged in said image forming apparatus or between said discharge end and a path of said charge receiving member and a pitch P (mm) between said discharge ends are determined to establish a relationship of $4 \leqq D/P \leqq 6$.

6. The corona discharge device according to claim 1, wherein at least each discharge end portion including said discharge end of said discharge member is made of an electrically conductive material containing nickel in a range from 8% to 15% and chromium in a range from 16% to 20%, and is coated with a material having a high electric resistance.

7. The corona discharge device according to claim 6, wherein said electrically conductive material forming said discharge end portion contains molybdenum in a range from 2% to 3%.

8. A corona discharge device used in an electrophotographic image forming apparatus comprising:

a discharge member having sharp discharge ends, wherein at least each discharge end portion including said discharge end is coated with a material having a high electric resistance.

9. The corona discharge device according to claim 8, wherein said discharge member includes a plurality of sharp discharge ends arranged in a row, and a distance D (mm) of a space between a discharge end and a charge receiving member to be charged in said image forming apparatus or between said discharge end and a path of said charge receiving member and a pitch P (mm) between said discharge ends are determined to establish a relationship of $4 \leqq D/P \leqq 6$.

10. A corona discharge device used in an electrophotographic image forming apparatus comprising:

a discharge member having a plurality of sharp discharge ends arranged in a row, wherein a distance D (mm) of a space between a discharge end and a charge receiving member to be charged in said image forming apparatus or between said discharge end and a path of said charge receiving member, and a pitch P (mm) between said discharge ends are determined to establish a relationship of $4 \leqq D/P \leqq 6$.

11. A corona discharge device used in an electrophotographic image forming apparatus comprising:

a discharge member having sharp discharge ends, wherein at least each discharge end portion including said discharge end is made of an electrically conductive material containing nickel in a range from 8% to 15% and chromium in a range from 16% to 20%, and is coated with a material having a high electric resistance.

12. The corona discharge device according to claim 11, wherein said electrically conductive material contains molybdenum in a range from 2% to 3%.

13. The corona discharge device according to claim 11, wherein said discharge member includes a plurality of sharp discharge ends arranged in a row, and a distance D (mm) of a space between a discharge end and a charge receiving member to be charged in said image forming apparatus or between said discharge end and a path of said charge receiving member and a pitch P (mm) between said discharge ends are determined to establish a relationship of $4 \leqq D/P \leqq 6$.

14. The corona discharge device according to claim 13, wherein said electrically conductive material forming said discharge end portion contains molybdenum in a range from 2% to 3%.

15. The corona discharge device according to any one of claims 1, 2, 3, 4, 5, 6 and 7, wherein said AC voltage component has a frequency in a range from 400 Hz to 1.5 kHz.

16. The corona discharge device according to any one of claims 1, 2, 3, 4, 5, 6 and 7, wherein application of said discharge voltage by said discharge voltage applying means generates a discharge current having positive and negative current components, of which sum is in a range from −200 $\mu$A to +100 $\mu$A.

17. The corona discharge device according to any one of claims 11, 12, 2, 3, 6, 7, 13 and 14, wherein said electrically conductive material is iron alloy containing iron as a major substance.

18. The corona discharge device according to any one of claims 8, 11, 12, 4, 9, 6, 7, 13 and 14, wherein said material having a high electric resistance, with which said discharge end portion is coated, is dielectric ceramics and forms a coating having a thickness not more than 0.1 mm.

19. The corona discharge device according to any one of claims 10, 5, 9, 13 and 14 wherein said discharge member has a saw-toothed form, of which tooth angle $\theta$ is in a range from 5° to 15°.

20. The corona discharge device according to any one of claims 10, 5, 9, 13 and 14 wherein said discharge member has a saw-toothed form and includes tooth portions having a thickness t in a range from 0.05 mm to 0.1 mm.

* * * * *